US008948413B2

(12) United States Patent
Abe et al.

(10) Patent No.: US 8,948,413 B2
(45) Date of Patent: Feb. 3, 2015

(54) AUDIO APPARATUS

(75) Inventors: Kensaku Abe, Saitama (JP); Ichiro Nakajima, Chiba (JP); Yoshitada Fujiwara, Tokyo (JP)

(73) Assignee: Sony Corporation, Tokyo (JP)

( * ) Notice: Subject to any disclaimer, the term of this patent is extended or adjusted under 35 U.S.C. 154(b) by 337 days.

(21) Appl. No.: 13/429,011

(22) Filed: Mar. 23, 2012

(65) Prior Publication Data

US 2012/0183160 A1 Jul. 19, 2012

Related U.S. Application Data

(62) Division of application No. 11/859,237, filed on Sep. 21, 2007, now Pat. No. 8,335,320.

(30) Foreign Application Priority Data

Oct. 3, 2006 (JP) ..... 2006-272204
Oct. 3, 2006 (JP) ..... 2006-272205
Oct. 3, 2006 (JP) ..... 2006/272206

(51) Int. Cl.
*H04R 1/10* (2006.01)
*G10K 11/178* (2006.01)
*H04R 3/00* (2006.01)

(52) U.S. Cl.
CPC ..... *G10K 11/178* (2013.01); *G10K 2210/1081* (2013.01)
USPC ..... 381/74; 381/111

(58) Field of Classification Search
CPC ..... H04R 2420/05; H04R 5/04; H04R 3/00; H04R 19/04
USPC ..... 381/111, 116, 74, 71.6, 77, 58
See application file for complete search history.

(56) References Cited

U.S. PATENT DOCUMENTS 7,187,775 B2 * 3/2007 Fujita ..... 381/111
7,293,122 B1 * 11/2007 Schubert et al. ..... 710/62

FOREIGN PATENT DOCUMENTS

JP 2-36297 3/1990
JP 2-126497 10/1990

(Continued)

OTHER PUBLICATIONS

Office Action issued May 31, 2011, in Japan Patent Application No. 2006-272204.

(Continued)

*Primary Examiner* — Vivian Chin
*Assistant Examiner* — Ammar Hamid
(74) *Attorney, Agent, or Firm* — Oblon, Spivak, McClelland, Maier & Neustadt, L.L.P.

(57) ABSTRACT

An audio apparatus includes: a connector that supports a multipolar plug including a plurality of plug terminals, the connector having a plurality of connector terminals including an input terminal of an audio collection section and an output terminal that outputs a noise canceling signal; a signal amplification section that amplifies a combined signal generated by combining the noise canceling signal and a reproduction audio signal, the signal amplification section being provided on an audio signal line that connects the input terminal and the output terminal; a detection section that detects whether the multipolar plug is inserted or pulled out by detecting change of voltage of a voltage supply line connected to the audio signal line; and a suppression section that suppresses output from the signal amplification section when the multipolar plug is pulled out but does not suppress the output when the multipolar plug is inserted.

10 Claims, 25 Drawing Sheets

(56) References Cited

FOREIGN PATENT DOCUMENTS

| | | |
|---|---|---|
| JP | 5-31161 | 4/1993 |
| JP | 6-73995 | 10/1994 |
| JP | 8-163686 | 6/1996 |
| JP | 9-37383 | 2/1997 |
| JP | 10-290128 | 10/1998 |
| JP | 11-136784 | 5/1999 |
| JP | 11-196488 | 7/1999 |
| JP | 2000-59876 | 2/2000 |
| JP | 2001-169385 | 6/2001 |
| JP | 2002-27079 | 1/2002 |
| JP | 2002-141980 | 5/2002 |
| JP | 2002-330485 | 11/2002 |
| JP | 2003-167584 | 6/2003 |
| JP | 2004-328419 | 11/2004 |
| JP | 2005-86417 | 3/2005 |
| JP | 2006-164669 | 6/2006 |

OTHER PUBLICATIONS

Office Action issued Jul. 5, 2011, in Japanese Patent Application No. 2006-272205 (with English-language translation).

Japanese Office Action issued Sep. 20, 2011, in Patent Application No. 2006-272206 (with English-language translation).

* cited by examiner

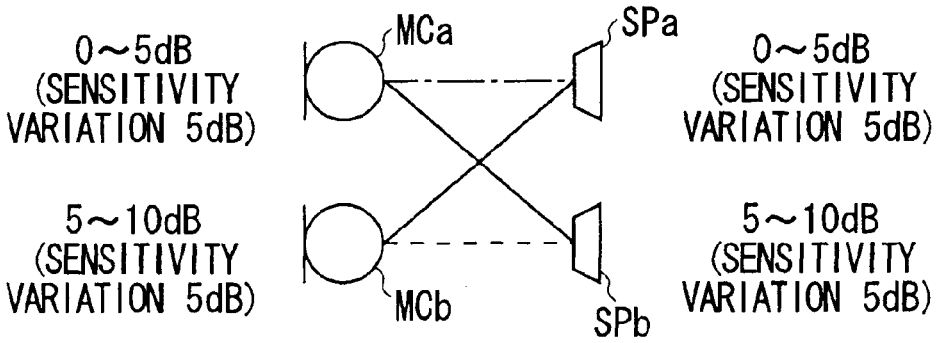
FIG. 21
FIG. 22A
WHEN NOT CONSIDERING COMBINATION (NORMAL)
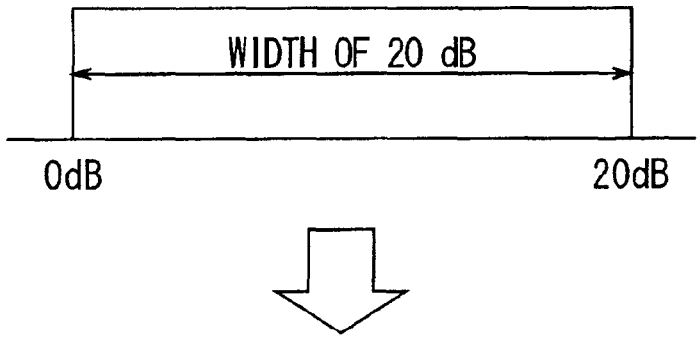
FIG. 22B
WHEN CONSIDERING COMBINATION
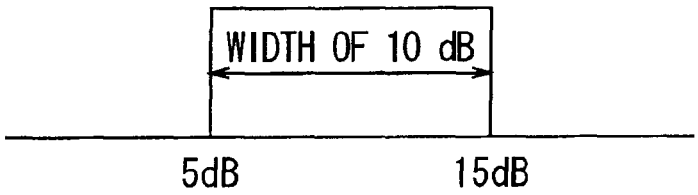

AUDIO APPARATUS

CROSS REFERENCES TO RELATED APPLICATIONS

This application is a divisional of U.S. application Ser. No. 11/859,237, filed Sep. 21, 2007, and is based upon and claims the benefit of priority from prior Japanese Patent Application JP2006-272204, JP2006-272205 and JP2006-272206 filed in the Japanese Patent Office on Oct. 3, 2006, the entire contents of each of which being incorporated herein by reference.

BACKGROUND OF THE INVENTION

1. Field of the Invention

The present invention relates to an audio apparatus, and is preferably applied to a noise-canceling apparatus, for example.

2. Description of the Related Art

There is a noise canceling headphone including a microphone: The noise canceling headphone is designed to collect noise around a user, invert it and then supply it from a driver unit to a headphone to cancel the noise (see Jpn. Pat. Laid-open Publication No. 2002-330485, for example).

The noise canceling headphone includes a plug on which there are plug terminals. If a microphone input terminal and a speaker output terminal are placed parallel to the plug-pulling insertion direction, the speaker output terminal on the plug may contact the microphone input terminal on a connector when the plug is pulled out of the connector. This may cause oscillation (so-called howling) due to an output signal from a speaker which returns to the microphone.

Accordingly, an audio apparatus, to which the noise canceling headphone is connected, may have a switch system to prevent the oscillation from happening. In this case, the audio apparatus includes a switch connected to wires in a cable, whose rod-like switch lever is parallel to the plug-pulling insertion direction. When the plug is being inserted into a jack a tip end section of the switch lever touches an end surface of the jack. When the plug has been inserted into the jack completely the end surface pushes the switch lever to open the switch (see Jpn. Pat. Laid-open Publication No. H5-31161, for example).

In addition, the audio apparatus may include a connection detection system for F-type connector to detect whether the headphone is connected. This allows the audio apparatus to output a signal to a different section when the noise canceling headphone is connected to the audio apparatus while the audio apparatus outputs a signal to a certain section when an ordinary headphone with no microphone is connected to the audio apparatus (see Jpn. Pat. Laid-open Publication No. 2006-164669, for example).

SUMMARY OF THE INVENTION

However, since the above switch system allocates a space for the switch and for its lever that moves, the audio apparatus may become large in size.

On the other hand, it is difficult to downsize the noise canceling headphone that includes an electric circuit for noise canceling inside a housing of the headphone.

In addition, since the above connection detection system for F-type connector includes an additional detection terminal on the F-type connector and a detection circuit for the detection terminal, the audio apparatus may become large in size.

The present invention has been made in view of the above points and is intended to provide an audio apparatus, headphone, noise reduction system, input switching apparatus and the like that can downsize the apparatus.

In one aspect of the present invention, an audio apparatus includes: a connector that supports a multipolar plug including a plurality of plug terminals, the connector having a plurality of connector terminals including an input terminal of an audio collection section and an output terminal that outputs a noise canceling signal whose phase is opposite to an audio signal supplied from the input terminal; a signal amplification section that amplifies a combined signal generated by combining the noise canceling signal and a reproduction audio signal, the signal amplification section being provided on an audio signal line that connects the input terminal and the output terminal; a detection section that detects whether the multipolar plug is inserted or pulled out by detecting change of voltage of a voltage supply line connected to the audio signal line, the voltage supply line supplying a reference voltage to the audio collection section via the audio signal line; and a suppression section that suppresses output from the signal amplification section when the detection section detects that the multipolar plug is pulled out but does not suppress the output when the detection section detects that the multipolar plug is inserted.

In another aspect of the present invention, an output suppression method for suppressing output of an audio signal in response to insertion and pulling out of a multipolar plug having a plurality of plug terminals from a corresponding connector having a plurality of connector terminals including an input terminal of an audio collection section and an output terminal that outputs a noise canceling signal whose phase is opposite to an audio signal supplied from the input terminal, the output suppression method including: a detection step of detecting whether the multipolar plug is inserted or pulled out by detecting change of voltage of a voltage supply line connected to an audio signal line that connects the input terminal and the output terminal, the voltage supply line supplying a reference voltage to the audio collection section via the audio signal line; and a control step of suppressing output from a signal amplification section provided on the audio signal line when the detection section detects that the multipolar plug is pulled out while not suppressing the output when the detection section detects that the multipolar plug is inserted.

In another aspect of the present invention, a storage medium storing a computer-readable program for suppressing output of an audio signal in response to insertion and pulling out of a multipolar plug having a plurality of plug terminals from a corresponding connector having a plurality of connector terminals including an input terminal of an audio collection section and an output terminal that outputs a noise canceling signal whose phase is opposite to an audio signal supplied from the input terminal, the program causing a computer to execute: a process of detecting whether the multipolar plug is inserted or pulled out by detecting change of voltage of a voltage supply line connected to an audio signal line that connects the input terminal and the output terminal, the voltage supply line supplying a reference voltage to the audio collection section via the audio signal line; and a process of controlling a suppression section to suppress output from a signal amplification section provided on the audio signal line when the process detects that the multipolar plug is pulled out while allowing the suppression section not to suppress the output when the process detects that the multipolar plug is inserted.

In another aspect of the present invention, a headphone connected to an electronic device including an electronic circuit that inverts a noise signal collected by an audio collection section and then outputs from an audio output section an inverted reduction signal to reduce noise, the headphone including an adjustment section provided between the electronic circuit of the electronic device and the audio output section, the adjustment section adjusting variation regarding the acoustic characteristic of the audio collection section and the audio output section while the electronic device adjusts variation regarding the electric characteristic of the electronic circuit.

In another aspect of the present invention, a noise reduction system including: a headphone including an audio collection section and an audio output section; and an electronic device including an electronic circuit that inverts a noise signal collected by the audio collection section and then outputs from the audio output section an inverted reduction signal to reduce noise, wherein the electronic device includes a first adjustment section that adjusts variation regarding the electric characteristic of the electronic circuit while the headphone includes a second adjustment section that adjusts variation regarding the acoustic characteristic of the audio collection section and the audio output section.

In another aspect of the present invention, an input switching apparatus including: a resistance provided between a signal input line connected to a connector terminal corresponding to a plug terminal connected to an input device and a voltage supply line that supplies voltage to the input device via the signal input line, the connector terminal being one of the connector terminals provided on a connector that supports a multipolar plug; a detection section connected to the signal input line, the detection section detecting whether the multipolar plug is connected by observing change of voltage of the signal input line; an open switch provided between a connection point of the resistance on the side of the voltage supply line and an adjusting resistance provided on the voltage supply line, the adjusting resistance adjusting the voltage; and a control section that closes the open switch when the detection section detects that the multipolar plug is connected.

In another aspect of the present invention, an input switching method including: a detection control step of controlling a detection section to detect whether a multipolar plug is connected by observing change of voltage of a signal input line connected to a connector terminal corresponding to a plug terminal connected to an input device, the connector terminal being one of the connector terminals provided on a connector that supports the multipolar plug; and an open switch control step of closing, in response to the detection result of the detection section, an open switch provided between an adjusting resistance provided on a voltage supply line to adjust a voltage supplied from the voltage supply line to the input device via the signal input line and a connection point of a resistance provided between the voltage supply line and the signal input line, the connection point being on the side of the voltage supply line.

In another aspect of the present invention, a storage medium storing a computer-readable program for causing a computer to execute: a detection control step of controlling a detection section to detect whether a multipolar plug is connected by observing change of voltage of a signal input line connected to a connector terminal corresponding to a plug terminal connected to an input device, the connector terminal being one of the connector terminals provided on a connector that supports the multipolar plug; and an open switch control step of closing, in response to the detection result of the detection section, an open switch provided between an adjusting resistance provided on a voltage supply line to adjust a voltage supplied from the voltage supply line to the input device via the signal input line and a connection point of a resistance provided between the voltage supply line and the signal input line, the connection point being on the side of the voltage supply line.

As for the above audio apparatus, output suppression method and storage medium thereof, the output from the signal amplification section on the audio signal line is suppressed when the plug is pulled out of the connector. Even if a microphone input terminal of the connector contacts a speaker output terminal of the plug when the plug is pulled out of the connector, the output from the audio signal line does not return. This prevents the oscillation (howling) from happening.

In addition, the connection of the plug is detected based on the change of the voltage supplied to the microphone input terminal. Accordingly, that can suppress the output from the signal amplification section on the audio signal line without being equipped with a switch lever.

In that manner, that can prevent howling from happening by detecting the insertion and removal of the plug even if the multipolar plug does not have any means for controlling a switch. Accordingly, the audio apparatus can be downsized.

As for the above headphone, it can be downsized because it only includes an adjustment section that adjusts variation regarding the acoustic characteristic of the audio collection section and audio output section. In addition, variation regarding the electronic device and headphone is totally suppressed when the adjustment section provided between the electronic circuit of the electronic device and the audio output section is adjusted. This improves noise canceling capability. Accordingly, the headphone is easy to use.

As for the above noise reduction system, the electric characteristic of the electronic device and the acoustic characteristic of the headphone can be adjusted separately. Accordingly, the noise reduction system can appropriately reduce noise even if a headphone is used along with any electronic devices. Thus, the noise reduction system is easy-to-use.

As for the above input switching apparatus, input switching method and storage medium storing a program thereof, it detects the connection of the multipolar plug by observing change of voltage supplied from the voltage supply line to the signal input line via the resistance when the open switch is not closed. On the other hand, when the open switch is closed, the resistance between the signal input line and the voltage supply line and the adjusting resistance divide the voltage and then supply a resulting reference voltage to the input device while the input device is allowed to input an input signal. That is, the signal input line also serves as a line for detecting the connection of the multipolar plug. Accordingly, the multipolar plug does not have to have an additional terminal for detecting the connection of the multipolar plug. Thus, the input switching apparatus can be downsized.

The nature, principle and utility of the invention will become more apparent from the following detailed description when read in conjunction with the accompanying drawings in which like parts are designated by like reference numerals or characters.

BRIEF DESCRIPTION OF THE DRAWINGS

In the accompanying drawings:

FIG. 21 is a schematic diagram illustrating combination patterns of microphones and speakers;

FIGS. 22A and 22B are schematic diagrams illustrating variation regarding a pair of a microphone and a speaker;

DETAILED DESCRIPTION OF PREFERRED EMBODIMENTS

An embodiment of the present invention will be described in detail with reference to the accompanying drawings.

(1) First Embodiment (1-1) Appearance Configuration of a Portable Music Player

Figure 1:
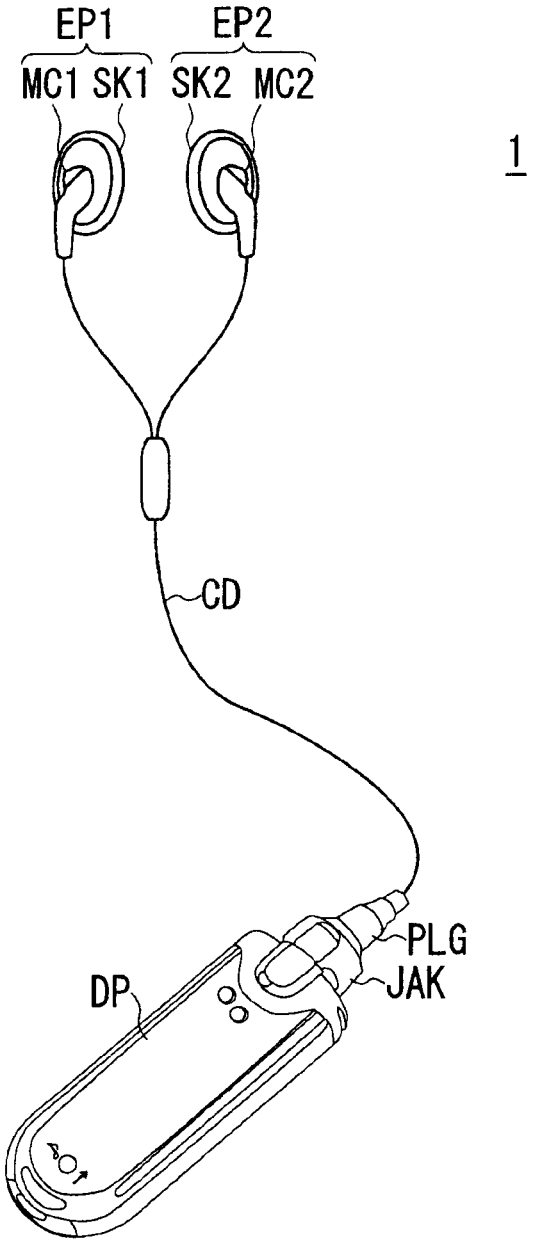
FIG. 1 is a schematic diagram illustrating the appearance configuration of a portable music player.

FIG. 1 illustrates the appearance configuration of a portable music player including a hard disk as a storage medium for storing audio signals (data). The portable music player 1 is substantially rectangular parallelepiped in shape with rounded ends, which a user can hold up by one hand.

On the surface of a housing of the portable music player 1 are placed various buttons, a display section DP and the like. The portable music player 1 also includes a jack JAK at a predetermined position, to which a plug PLG of a noise canceling earphones EP1 and EP2 are connected. The plug PLG is connected to the earphones EP1 and EP2 via codes CD. The earphones EP1 and EP2 include a microphone (The earphones EP1 and EP2 are also referred to as "microphone-attached earphones").

The plug PLG of the microphone-attached earphones EP1 and EP2 can be inserted into or pulled out of the jack JAK of the portable music player 1. In addition, the earphone or headphone with no noise canceling function can be inserted into or pulled out of the jack JAK.

(1-2) Configuration of the Plug and Jack

Following describes the plug PLG and the jack JAK, which are based on the specification of a standard mini plug.

(1-2-1) Configuration of the Plug

As shown in FIGS. 2 to 6, the plug PLG includes a first conductor 11, a first insulator 12, a second conductor 13, a second insulator 14, a third conductor 15, a third insulator 16, a fourth conductor 17, a fourth insulator 18 and a fifth conductor 19.

The first conductor 11, the second conductor 13, the third conductor 15, the fourth conductor 17 and the fifth conductor 19 are made from a highly electrically conductive metal material while the first insulator 12, the second insulator 14, the third insulator 16 and the fourth insulator 18 are made from a resin or the like with no electrically conductivity.

In this embodiment, the first conductor 11 is designed as a left (or right) speaker terminal while the second conductor 13 is designed as a right (or left) speaker terminal. In addition, the third conductor 15 is designed as a ground terminal. Moreover, the fourth conductor 14 is designed as a left (or right) microphone terminal while the fifth conductor 19 is designed as a right (or left) microphone terminal.

The first conductor 11 is substantially a circular rod in shape. The first conductor 11 includes a large-diameter electrode 11*a* and a small-diameter mating section 11*b*. The first conductor 11 includes a flange section 11*c* extending outwardly from between the electrode 11*a* and the mating section 11*b*. On the opposite end of the flange section 11*c* of the mating section 11*b* is a code connection section 11*d*.

An outer surface of the electrode 11*a* is formed as an incline surface 11*e* that inclines toward the center as it closes in the mating section 11*b*. The longitudinal side of the mating section 11*b* is longer than that of the electrode 11*b*. The diameter of the code connection section 11*d* is smaller than that of the electrode 11*a* and is larger than that of the mating section 11*b*.

The first insulator 12 is substantially a cylinder in shape. The diameter of a large-diameter section 12*a* at the end of the longitudinal side of the first insulator 12 is larger than that of a small-diameter section 12*b*. The large-diameter section 12*a* is thicker than the small-diameter section 12*b*. A protruding section 12*c* at the other end of the longitudinal side of the small-diameter section 12*b* is slightly protruding outwardly. A shallow mating concave section 12*d* is formed at the outer surface of the small-diameter section 12*b* between the large-diameter section 12*a* and the protruding section 12*c*.

The first insulator 12 is embedded in the mating section 11*b* of the first conductor 11 such as the first insulator 12 covers the first conductor 11. In addition, the outer surface of the large-diameter section 12*a* is aligned with the outer surface of the flange section 11*c* in the radiation direction. The electrode 11*a*, flange section 11*c* and code connection section 11*d* of the first conductor 11 are exposed.

The second conductor 13 is substantially a cylinder in shape. The second conductor 13 includes a large-diameter electrode 13*a* and a small-diameter mating section 13*b*. The second conductor 13 includes a circular-ring-shaped connection section 13*c* that connects the electrode 13*a* and the mating section 13*b*. While the second conductor 13 has the mating section 13*b* and the connection section 13*c* on one end, on the other end of the second conductor 13 is a code connection section 13*d*.

The second conductor 13 is embedded in the first insulator 12 such that the second conductor 13 covers the first insulator 12. In addition, the electrode 13*a* covers the large-diameter section 12*a* such that one end of the large-diameter section 12*a* is exposed. Moreover, the mating section 13*b* and the connection section 13*c* are embedded in the mating concave section 12*d* such that the outer surface of the mating section 13*b* is aligned with the outer surface of the protruding section 12*c* in the radiation direction. Accordingly, part of the large-diameter section 12*a* and the protruding section 12*c* are exposed.

The second insulator 14 is substantially a cylinder in shape. The diameter of a large-diameter section 14*a* on one end of the longitudinal side of the second insulator 14 is larger than that of a small-diameter section 14*b*. The large diameter section 14*a* is thicker than the small-diameter section 14*b*. On the opposite end of the large-diameter section 14*a*, or on the other end of the small-diameter section 14*b*, is a protruding section 14*c* that slightly protrudes outwardly. A shallow mating concave section 14*d* is formed on the outer surface of the second insulator 14 between the large-diameter section 14*a* and the protruding section 14*c*.

The second insulator 14 is embedded in the mating section 13*b* of the second conductor 13 such as the second insulator 14 covers the second conductor 13. In addition, the outer surface of the large-diameter section 14*a* is aligned with the outer surface of the electrode 13*a* in the radiation direction. The electrode 13*a* and code connection section 13*d* of the second conductor 13 are exposed.

The third conductor 15 is substantially a cylinder in shape. The third conductor 15 includes a large-diameter electrode 15*a* and a small-diameter mating section 15*b*. The third conductor 15 includes a circular-ring-shaped connection section 15*c* that connects the electrode 15*a* and the mating section 15*b*. While the third conductor 15 has the mating section 15*b* and the connection section 15*c* on one end, on the other end of the third conductor 15 is a code connection section 15*d*.

The third conductor 15 is embedded in the second insulator 14 such that the third conductor 15 covers the second insulator 14. In addition, the third conductor 15 is connected to the mating concave section 14*d* such that the outer surface of the electrode 15*a* is aligned with the outer surface of the large-diameter section 14*a* in the radiation direction and the outer surface of the mating section 15*b* is aligned with the outer surface of the protruding section 14*c* in the radiation section. Accordingly, the large-diameter section 14*a* and protruding section 14*c* of the second insulator 14 are exposed.

The third insulator 16 is substantially a cylinder in shape. The third insulator 16 includes a large-diameter section 16*a* on one end of the longitudinal end of the third insulator 16 and a small-diameter section 16*b* adjacent to the large-diameter section 16*a*. On the other end of the longitudinal side of the third insulator 16 is a protruding section 16*c* whose diameter is larger than that of the small-diameter section 16*b*. The large-diameter section 16*a* and the protruding section 16*c* are thicker than the small diameter section 16*b*. Between the large-diameter section 16*a* and the protruding section 16*c* is a shallow mating concave section 16*d* on the outer surface of the third insulator 16.

The third insulator 16 is embedded into the mating section 15*b* of the third conductor 15 such that the outer surfaces of the large-diameter section 16*a* and protruding section 16*c* are aligned with the outer surface of the electrode 15*a* in the radiation direction. As a result, the electrode 15*a* and code connection section 15*d* of the third conductor 15 are exposed.

The fourth conductor 17 is substantially a cylinder in shape. The fourth conductor 17 includes an electrode 17*a*. In addition, on the center section of the longitudinal side of the electrode 17*a* is a circular-ring-shaped protruding section 17*b* that outwardly protrudes from the outer surface of the fourth conductor 17. One end of the electrode 17*a* is a code connection section 17*c*.

The fourth conductor 17 is embedded in the mating concave section 16*d* of the third insulator 16. In addition, the outer surface of the electrode 17*a* is aligned with the outer surfaces of the large-diameter section 16*a* and protruding section 16*c* in the radiation section. Accordingly, the large-diameter section 16*a* and protruding section 16*c* of the third insulator 16 are exposed.

Figure 4:
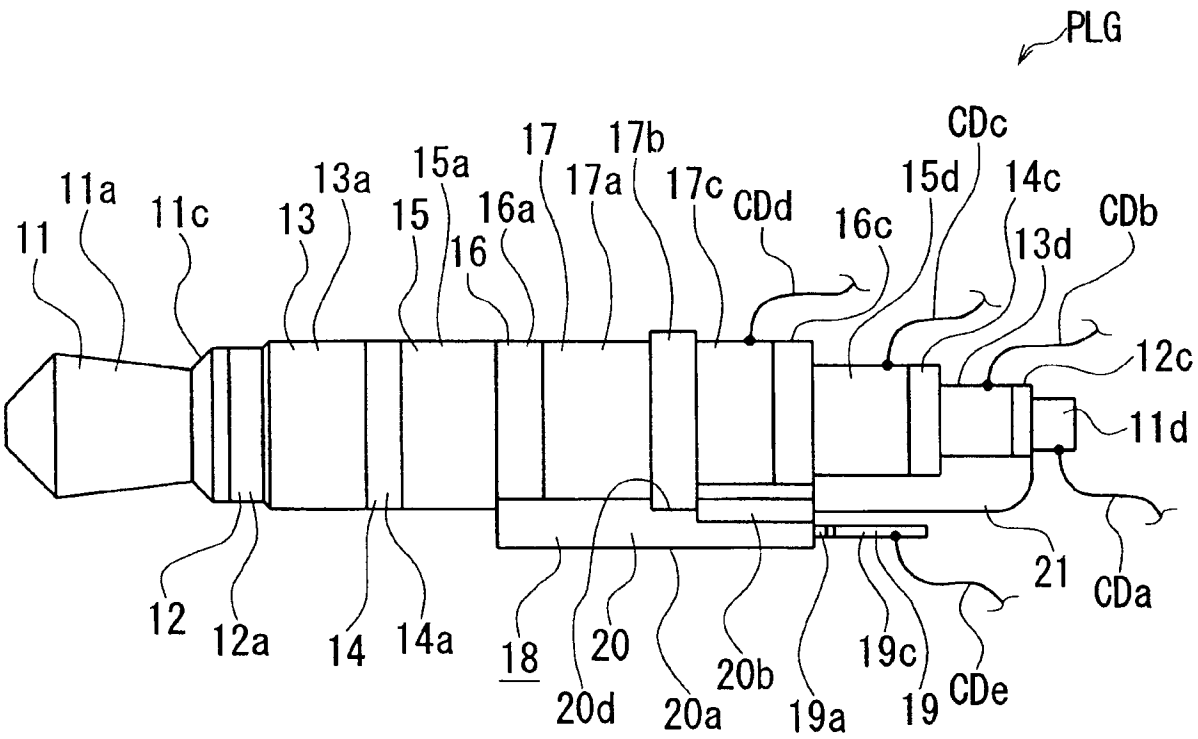
FIG. 4 is an enlarged side view of the plug (a different side from that shown in FIG. 3)
Figure 6:
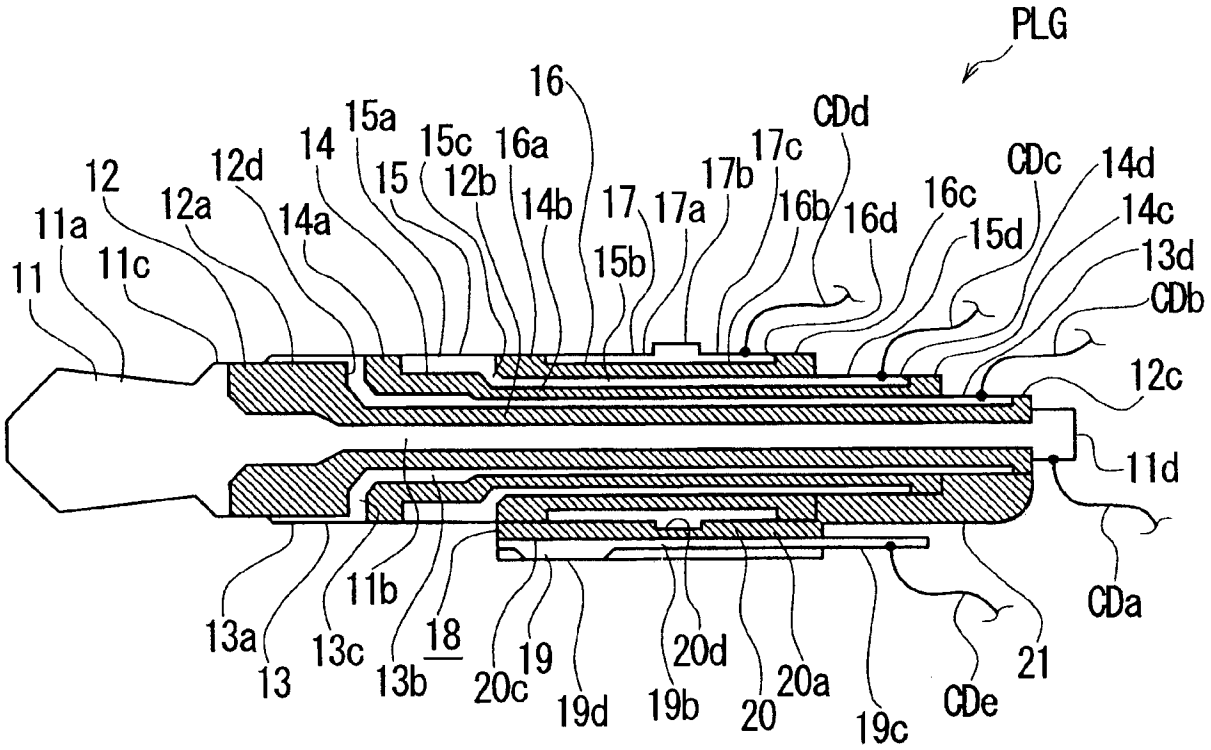
FIG. 6 is an enlarged cross sectional view of the plug (a different section from that shown in FIG. 5)

The fourth insulator 18 is combined with a conductor attachment section 20 and an extending section 21 as one unit (FIGS. 4 and 6).

Figure 7:
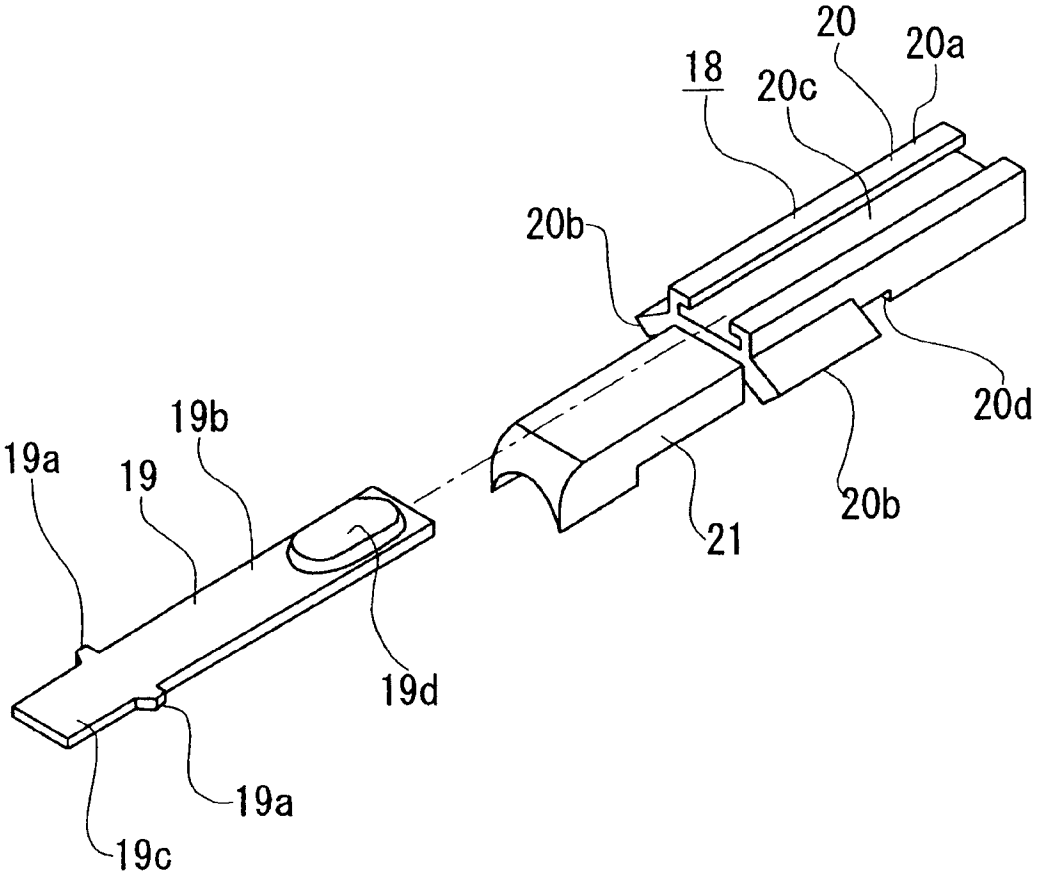
FIG. 7 is an enlarged perspective view of a fourth insulator and a fifth conductor.

As shown in FIG. 7, the conductor attachment section 20 is long in one direction. The conductor attachment section 20 includes a main body section 20*a*. On one end of the longitudinal side of the main body section 20*a* are protruding sections 20*b* and 20*b*, each of which protrudes in an opposite direction along the shorter side of the main body section 20*a*. A conductor attachment grave 20*c* extends along the longitudinal side of the main body section 20*a* while a mating grave 20*d* extends along the shorter side of the main body section 20*a* on a surface opposite to that of the conductor attachment grave 20*c*. The extending section 21 extends from one end of the longitudinal side of the conductor attachment section 20 in a direction perpendicular to the protruding sections 20*b* and 20*b*.

The fourth insulator 18 is attached to a part of the outer surface of the conductor attachment section 20, that part equivalent to an area extending from the large-diameter section 14*a* of the third insulator 14 to the protruding section 14*c*. The extending section 21 is attached to a part of the outer surface of the conductor attachment section 20, that part equivalent to an area extending from the code connection section 15*d* of the third conductor 15 to the protruding section 12*c* of the first insulator 12. In addition, a protruding section 17*b* of the fort conductor 17 is embedded in the mating grave 20*d* such that the conductor attachment section 20 is outside the extending section 21.

The fifth conductor 19 is substantially a long plate in shape. The fifth conductor 19 includes restriction protruding portions 19*a* and 19*a* on the center section of the longitudinal side of the fifth conductor. Each of the restriction protruding portions 19*a* and 19*a* protrudes in an opposite direction. The restriction protruding portions 19*a* and 19*a* exist as a reference and one end of the fifth conductor 19 is an insertion section 19*b* while the other end is a code connection section 19*c*. While one end of the insertion section 19*b* is the code connection section 19*c*, the other end has a connection protruding section 19*d* protruding along the thickness of the insertion section 19*b*.

Figure 3:
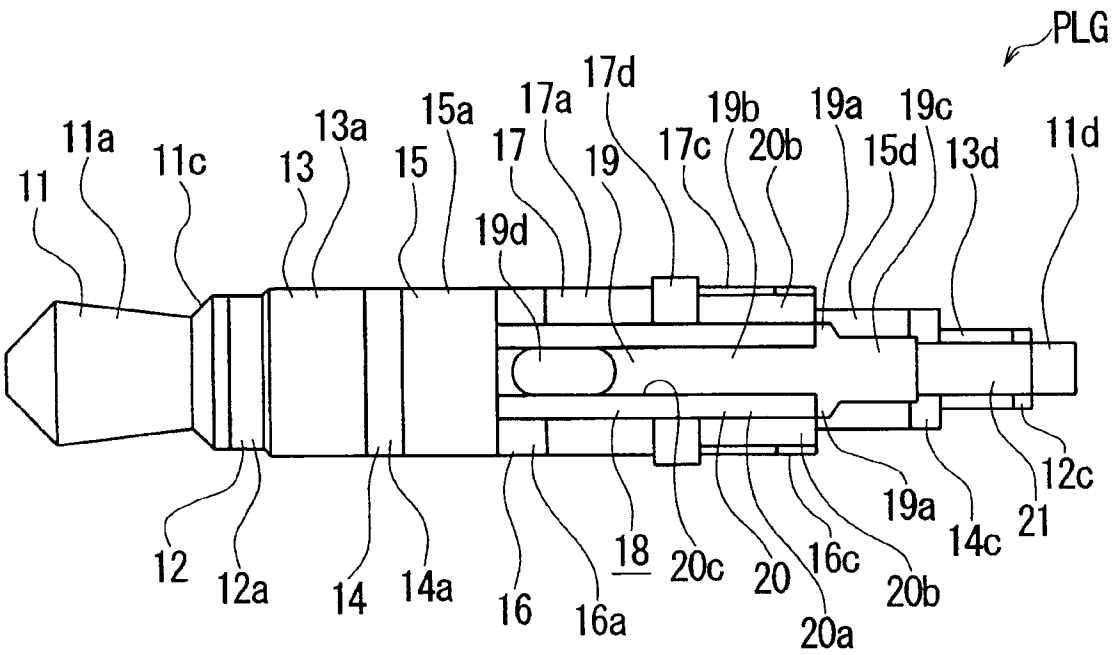
FIG. 3 is an enlarged side view of the plug.

The insertion section 19*b* of the fifth conductor is inserted into the conductor attachment grave 20*c*. In this manner, the fifth conductor 19 is attached to the fourth insulator 18 (FIG. 3). In addition, the restriction protruding portions 19*a* and 19*a* touch the one end of the main body section 20*a* such that the code connection section 19*c* is a certain distance away from the outer surface of the extending section 21 (FIG. 4).

Figure 5:
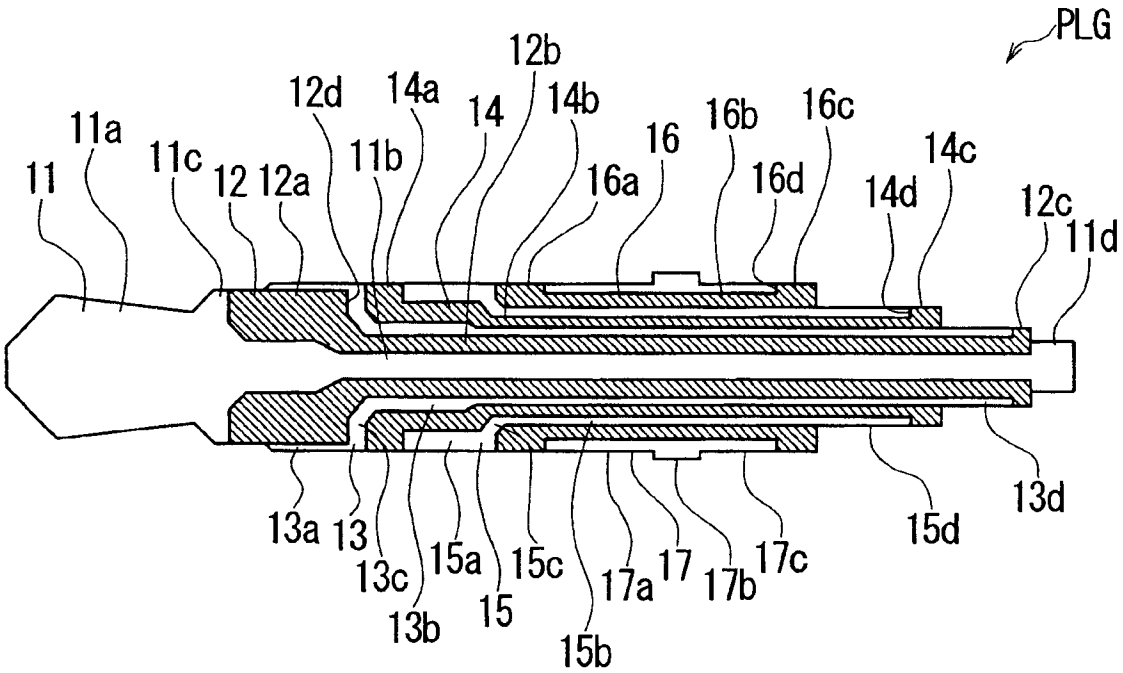
FIG. 5 is an enlarged cross sectional view of the plug.

The plug PLG is configured in the above manner. In addition, as shown in FIGS. 5 and 6, the code connection section 11*d* of the first conductor 11, the code connection section 13*d* of the second conductor 13, the code connection section 15*d* of the third conductor 15, the code connection section 17*c* of the fourth conductor 17 and the code connection section 19*c* of the fifth conductor 19 are connected or soldered to corresponding connection codes CDa, CDb, CDc, CDd and CDe, respectively.

The other ends of the connection codes CDa, CDb, CDc, CDd and CDe are connected to a left speaker SK1 of the left microphone-attached earphone EP1 (FIG. 1), a right speaker SK2 of the right microphone-attached earphone EP2 (FIG. 1), the grand terminal of the microphone-attached earphones ER1 and ER2 (not shown), a left microphone MC1 of the left microphone-attached earphone EP1 (FIG. 1) and a right microphone MC2 of right microphone-attached earphone EP1 (FIG. 1).

Figure 2:
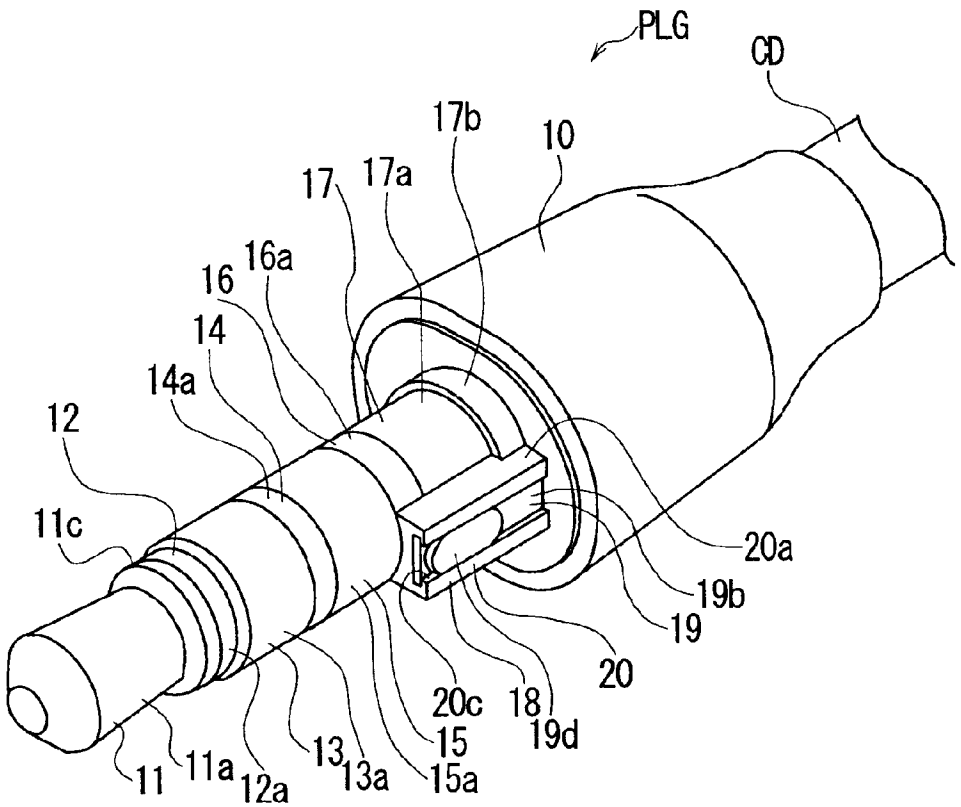
FIG. 2 is an enlarged perspective view of a plug.

By the way, the connection codes CDa, CDb, CDc, CDd and CDe are covered by a cover 10 extending from the protruding section 17*b* of the fourth conductor 17 to the code connection section 11*d* of the first conductor 11. In this manner the code connection sections 11*d*, 13*d*, 15*d*, 17*c* and 19*c* are capped (FIG. 2).

(1-2-2) Configuration of the Jack

Figure 8:
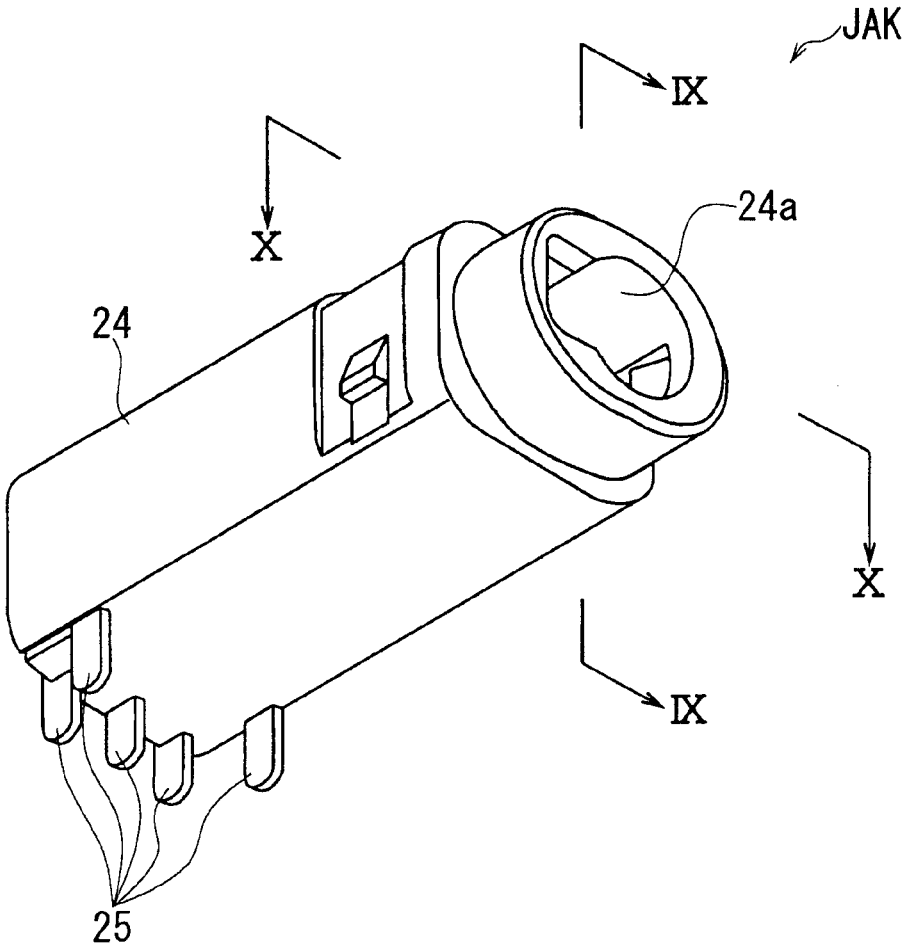
FIG. 8 is an enlarged perspective view of a jack.

The following describes the configuration of a jack JAK in which the plug PLG is inserted. As shown in FIG. 8, the jack JAK includes a housing 24 that is attached to a predetermined location of the portable music player 1.

The housing 24 has a plug insertion hole 24*a* whose one end is opening. Five terminal portions 25 are protruding from the other end of the plug insertion hole 24*a*. The terminal portions 25 are connected to an electric circuit of the portable music player 1.

Figure 9:
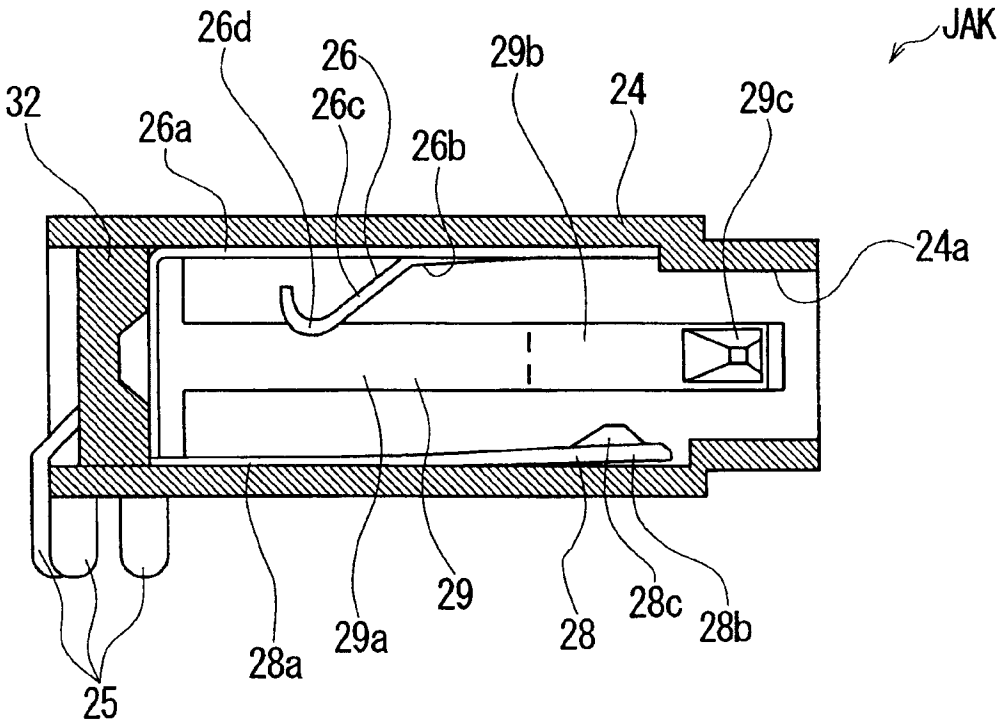
FIG. 9 is a cross sectional view of the jack along the line IX-IX.
Figure 10:
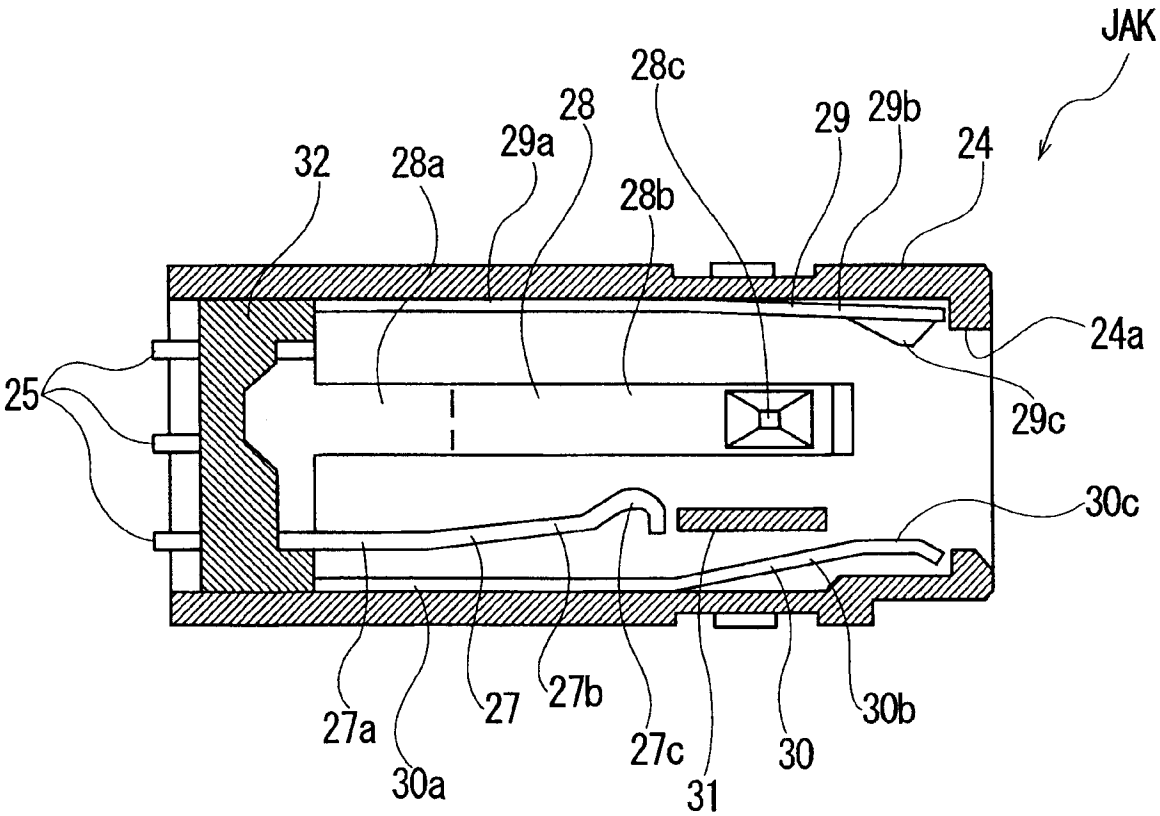
FIG. 10 is a cross sectional view of the jack along the line X-X.

As shown in FIGS. 9 and 10, there are a first connection terminal 26, a second connection terminal 27, a third connection terminal 28, a fourth connection terminal 29 and a fifth connection terminal 30 inside the housing 24.

The first connection terminal 26 (FIG. 9) includes: a base section 26*a*, which is disposed along the inner surface of the jack JAK; a base end section 26*b*, which is outwardly extending from the base section 26*a* after the base section 26*a* is folded around the plug insertion hole 24*a*; and a plate spring section 26*c*, which is extending from the base end section 26*b* and curved such that the plate spring section 26*c* gets away from the base section 26*a*. On the top end of the plate spring section 26*c* is a connection section 26*d*.

The second connection terminal 27 (FIG. 10) includes: a base end section 27*a*, which extends along the inner surface of the jack JAK; and a plate spring section 27*b*, which is extending from the base end section 27*a* and curved such that the plate spring section 27*b* gets away from inner surface of the jack JAK. On the top end of the plate spring section 27*b* is a connection section 27*c*. The connection section 27*c* is closer to the plug insertion hole 24*a* than is the connection section 26*d* of the first connection terminal 26.

The third connection terminal 28 (FIGS. 9 and 10) includes: a base end section 28*a*, which extends along the inner surface of the jack JAK; and a plate spring section 28*b*, which is extending from the base end section 28*a* and curved such that the plate spring section 28*b* gets away from inner surface of the jack JAK. On the top end of the plate spring section 28*b* is a connection section 28*c*. The connection section 28*c* is closer to the plug insertion hole 24*a* than is the connection section 27*c* of the second connection terminal 27.

The fourth connection terminal 29 (FIGS. 9 and 10) includes: a base end section 29*a*, which extends along the inner surface of the jack JAK; and a plate spring section 29*b*, which is extending from the base end section 29*a* and curved such that the plate spring section 29*b* gets away from inner surface of the jack JAK. On the top end of the plate spring section 29*b* is a connection section 29*c*. The connection section 29*c* is closer to the plug insertion hole 24*a* than is the connection section 28*c* of the third connection terminal 28. That is, the connection section 29*c* is adjacent to the opening of the plug insertion hole 24*a*.

The fifth connection terminal 30 (FIG. 10) includes: a base end section 30*a*, which extends along the inner surface of the jack JAK; and a plate spring section 30*b*, which is extending from the base end section 30*a* and curved such that the plate spring section 30*b* gets away from inner surface of the jack JAK. On the top end of the plate spring section 30*b* is a connection section 30*c*. The connection section 30*c* inside the plug insertion hole 24*a* is adjacent to the opening of the plug insertion hole 24*a*.

There is a stopper wall 31 inside the jack JAK (FIG. 10). The stopper wall 31 is placed such that the plate spring section 30*b* of the fifth connection terminal 30 is between the stopper wall 31 and the inner surface of the jack JAK.

There is a holding insulator member 32 inside the jack JAK (FIGS. 9 and 10). The holding insulator member 32 is placed on the other end of the plug insertion hole 24*a* while one end of the hole 24*a* is opening.

A part of the first connection terminal 26, second connection terminal 27, third connection terminal 28, fourth connection terminal 29 and fifth connection terminal 30 are embedded in the holding insulator member 32 and are connected to the terminal portions 25 respectively. As a result, the circuit of the portable music player 1 is connected via the terminal portions 25 to the first connection terminal 26, second connection terminal 27, third connection terminal 28, fourth connection terminal 29 and fifth connection terminal 30.

(1-2-3) Connection of the Plug and Jack

Figure 11:
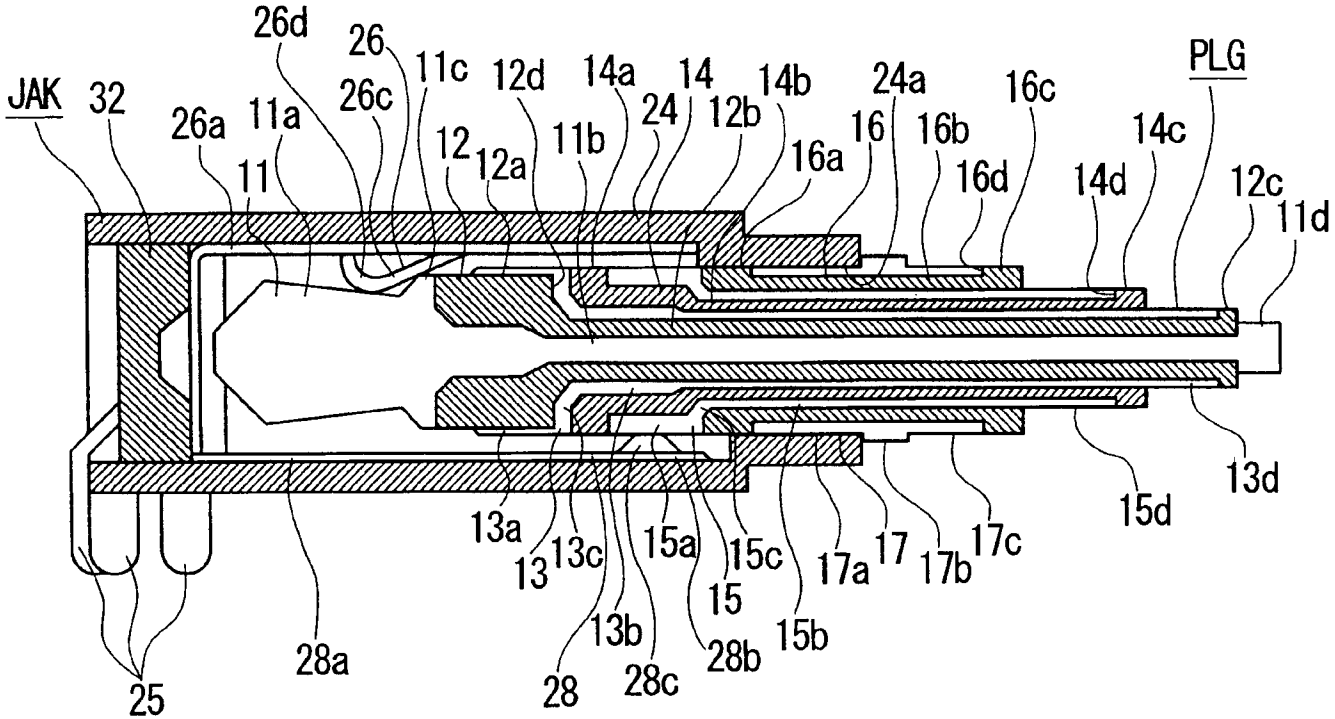
FIG. 11 is an enlarged cross sectional view of the plug connected to the jack.
Figure 12:
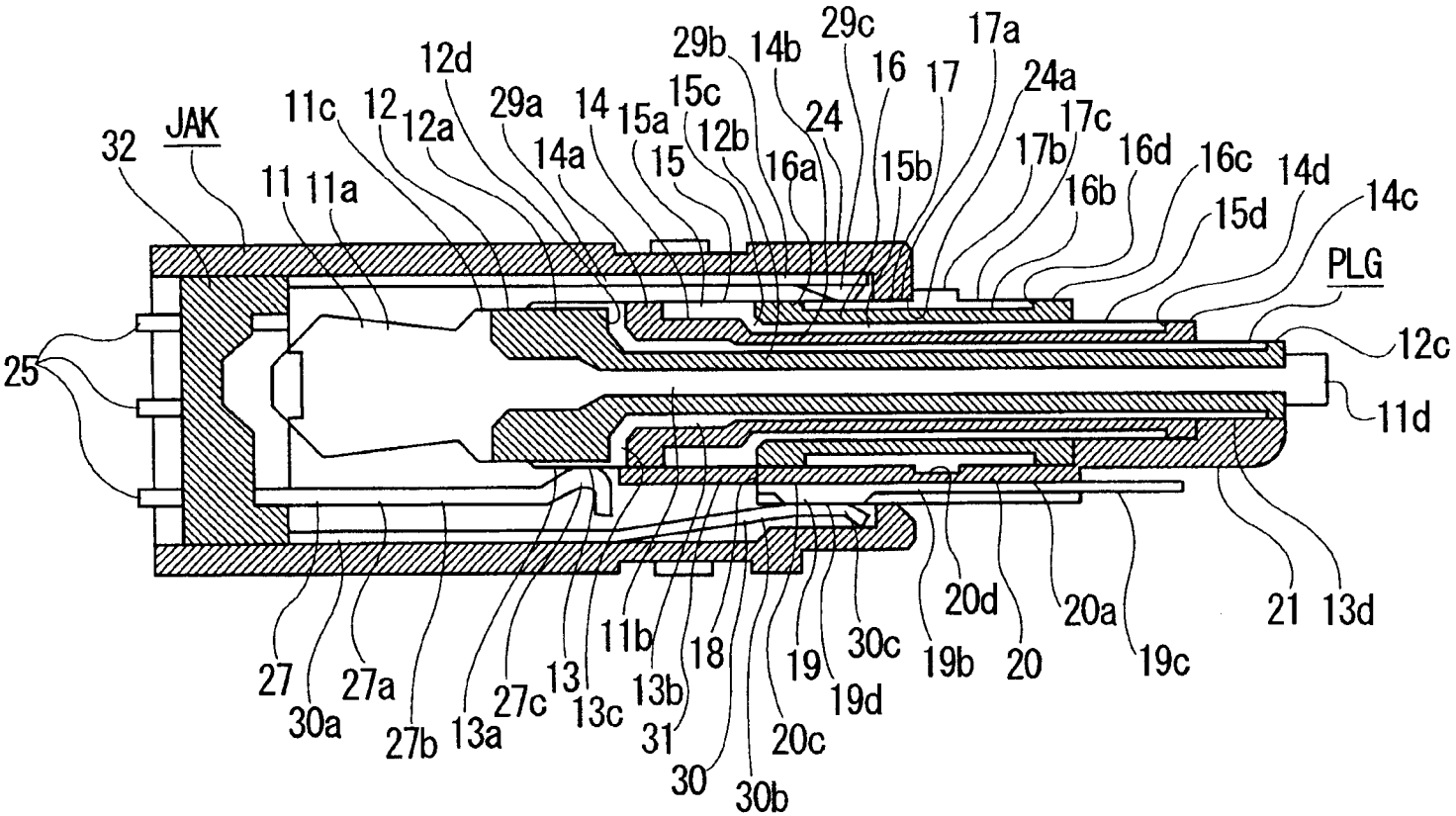
FIG. 12 is an enlarged cross sectional view of the plug connected to the jack (a different section from that shown in FIG. 11)

When the plug PLG is inserted in the plug insertion hole 24*a* of the jack JAK as shown in FIGS. 11 and 12, the electrode 11*a* of the first conductor 11, the electrode 13*a* of the second conductor 13, the electrode 15*a* of the third conductor 15, the electrode 17*a* of the fourth conductor 17 and the connection protruding section 19*a* of the fifth conductor 19 are connected to the first connection section 26*d* of the first connection terminal 26 for left (or right) speaker, the connection section 27*c* of the second connection terminal 27 for right (or left) speaker, the connection section 28*c* of the third connection terminal 28 for ground, the connection section 29*c* of the fourth connection terminal 29 for left (or right) microphone and the connection section 30*c* of the fifth connection terminal 30 for right (or left) microphone.

The plug PLG is inserted such that the protruding section 17*d* of the fourth conductor 17 touches the outer rim of the opening of the plug insertion hole 24*a* and one end of the insertion section 19*b* of the fifth conductor 19 touches the stopper wall 31. In that manner, the jack JAK is appropriately positioned in the insertion direction.

The connection sections 26*d*, 27*c*, 28*c*, 29*c* and 30*c* are distorted by the spring force against the base section 26*b*, 27*a*, 28*a*, 29*a* and 30*a* such that the connection sections 26*d*, 27*c*, 28*c*, 29*c* and 30*c* push the electrode 11*a*, 13*a*, 15*a* and 17*a* and the connection protruding section 19*a*.

(1-3) Circuit Configuration of the Portable Music Player

Figure 13:
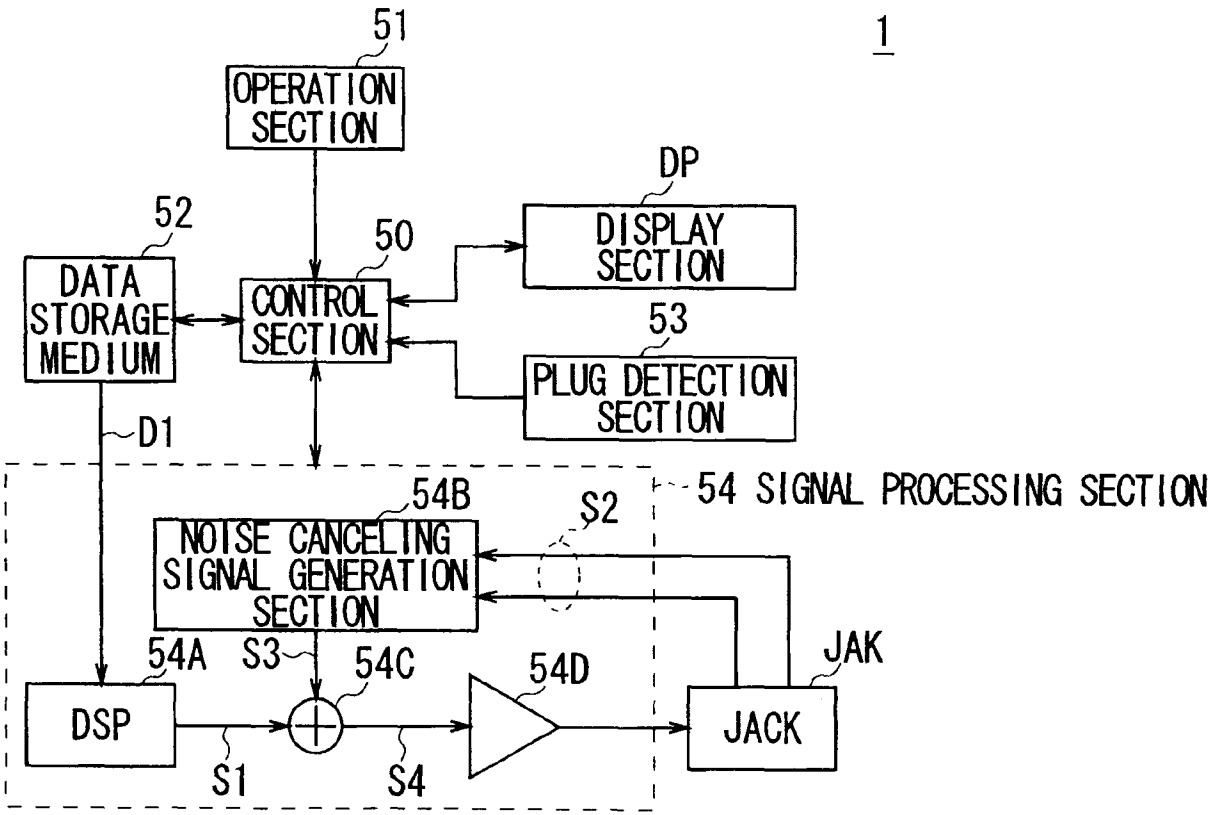
FIG. 13 is a block diagram illustrating the circuit configuration of a portable music player according to a first embodiment of the present invention.

Following describes the circuit configuration of the portable music player 1. As shown in FIG. 13, the portable music player 1 includes a control section 50 that takes overall control of the player 1. The control section 50 is connected to an operation section 51, a data storage medium 52, a plug detection section 53, a display section DP and a signal processing section 54.

The control section 50 is a microcomputer including a Central Processing Unit (CPU), a Read Only Memory (ROM), which stores various programs and setting data, and a Random Access Memory (RAM), which serves as a work memory for the CPU.

The control section 50 executes a program stored in the ROM to control the data storage medium 52, the display section DP and the signal processing section 54 based on the command data supplied from the operation section 51 and the setting data stored in the ROM.

The operation section 51 generates, when a user pushes various buttons on the surface of the portable music player 1, the command data, which is then supplied to the control section 50.

The data storage medium 52 is for example an Electrically Erasable Programmable Read Only Memory (EEPROM). The data storage medium 12 stores various data such as digital audio signals D1.

The display section DP is for example a fluorescent display on the surface of the portable music player 1 (FIG. 1). The display section DP displays information (characters, marks and the like) regarding music content, a current mode of playback, information about whether the noise canceling earphone (headphone) is connected and the like, based on the display data generated by the control section 50.

Figure 14:
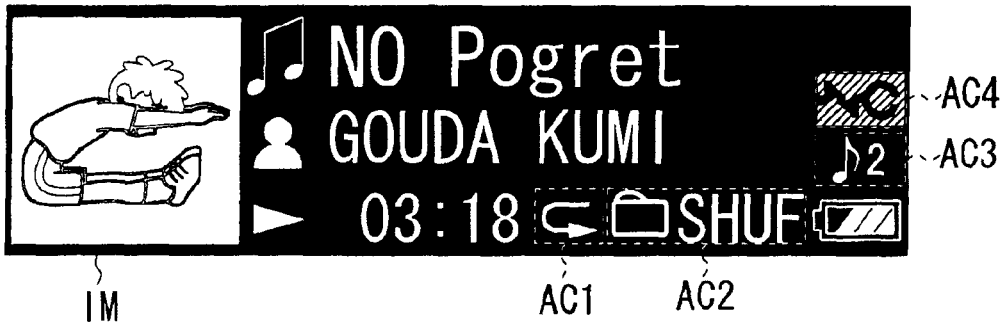
FIG. 14 is a schematic diagram illustrating a display screen.

FIG. 14 illustrates one of the examples regarding a display screen displayed on the display section DP. On the left side of the display screen is an image IM regarding currently-played music or a sample image (not shown) stored in the ROM as the setting data. On the upper center of the display screen is a title of the music. On the middle center of the display screen is an artist name of the music. On the bottom center of the display screen is an elapsed time of the music. On the right side of the display screen shows how much battery power is left.

There are a symbol AC1, indicating a repeat playback mode, and a symbol AC2, indicating a shuffle playback mode, on the left side of the battery symbol. There is a symbol AC3, indicating a surround mode with its mode number, on the upper side of the battery symbol. When a user specifies a mode, the corresponding symbol will be displayed.

On the other hand, above the symbol AC3 is a symbol AC4, indicating the fact that the noise canceling earphone (or headphone) has been connected. When the noise canceling earphone (or headphone) is connected, the symbol AC4 is displayed in a different color from other symbols. In this manner, the display screen highlights the fact that the noise canceling earphone (or headphone) has been connected.

The plug detection section 53 detects whether the plug PLG of the noise canceling earphone (or headphone) is connected. Specifically, to detect whether the plug PLG of the noise canceling earphone (or headphone) is connected, the plug detection section 53 detects, through the terminal (or the microphone input terminal) 30 corresponding to the plug's terminal 19 connected to the right microphone MC2 (FIG. 1) out of the terminals 26, 27, 28, 29 and 30 (FIGS. 9 and 10, for example) on the jack JAK, the change of voltage on a signal line (also referred to as a "voltage supply line") that supplies a reference voltage to the microphone.

By the way, when the standard mini plug of the earphone (or headphone) with no noise canceling function or the earphone (or headphone) with no microphone is connected, the plug's terminals are only connected to the connection terminals 26 and 27 for left and right speakers and the connection terminal 28 for ground, out of the connection terminals 26, 27, 28, 29 and 30 of the jack JAK (FIGS. 9 and 10, for example).

In this case, the voltage of the voltage supply line does not change. Accordingly, the plug detection section 53 determines that the plug PLG of the noise canceling earphone (or headphone) has not been connected.

When detecting that the plug PLG is inserted or pulled out the plug detection section 53 turns off a switch (not shown) on the audio line to shut off the audio signal input from the noise canceling earphone (or headphone).

A digital audio signal D1, reproduced from the data storage medium 52, is supplied to a Digital Signal Processor (DSP) 54A of the signal processing section 54. A first filter coefficient representing the frequency characteristic of the noise canceling mode is supplied to the DSP 54A as the setting data when the plug PLG of the noise canceling earphone (or headphone) is being inserted into the jack JAK, while a second filter coefficient representing the frequency characteristic of the non-noise canceling mode is supplied to the DSP 54A as the setting data when the plug PLG is not inserted.

The DSP 54A performs a filtering process on the digital audio signal D1 in accordance with the first or second filter coefficient. If the digital audio signal D1 has been compressed, the DSP 54A may decompress the digital audio signal D1.

In addition, the DSP 54A performs a Digital-to-Analog (D/A) conversion process on the signal to produce analog audio signals S1 for left and right channels, which are then supplied to a combination section 54C.

On the other hand, when the plug PLG of the noise canceling earphone (or headphone) has been inserted into the jack JAK, left- and right channels audio signals S2 are supplied to a noise canceling signal generation section 54 of the signal processing section 54 from the microphones MC1 and MC2 of the microphone-attached earphones EP1 and EP2 (FIG. 1) through the plug PLG.

The noise canceling signal generation section 54B inverts the left and right channels audio signals S2 and then supplies resultant noise canceling signals S3 to the combination section 54C.

The combination section 54*c* combines the left-channel analog audio signal S1 from the DSP 54A with the left-channel noise canceling signal S3 from the noise canceling signal generation section 54B and the right-channel analog audio signal S1 with the right-channel noise canceling signal S3. The combined audio signals are supplied to a signal amplifier 54D as audio output signals S4.

When the earphone (or headphone) with no noise canceling function has been inserted into the jack JAK, the noise canceling signal generation section 54B does not generate and supply the noise canceling signals S3. Accordingly, the analog audio signals S1 from the DSP 54A are supplied to the signal amplifier 54D as the audio output signal S4.

The signal amplifier 54D amplifies the audio output signal S4, supplied from the combination section 54C, in accordance with a volume control command data supplied from the operation section 51. The amplified signals are supplied to the connection terminals 26 and 27 of the jack JAK (FIGS. 9 and 10, for example).

(1-4) Plug Detection Section (1-4-1) Connection of the Plug Detection Section

Figure 15:
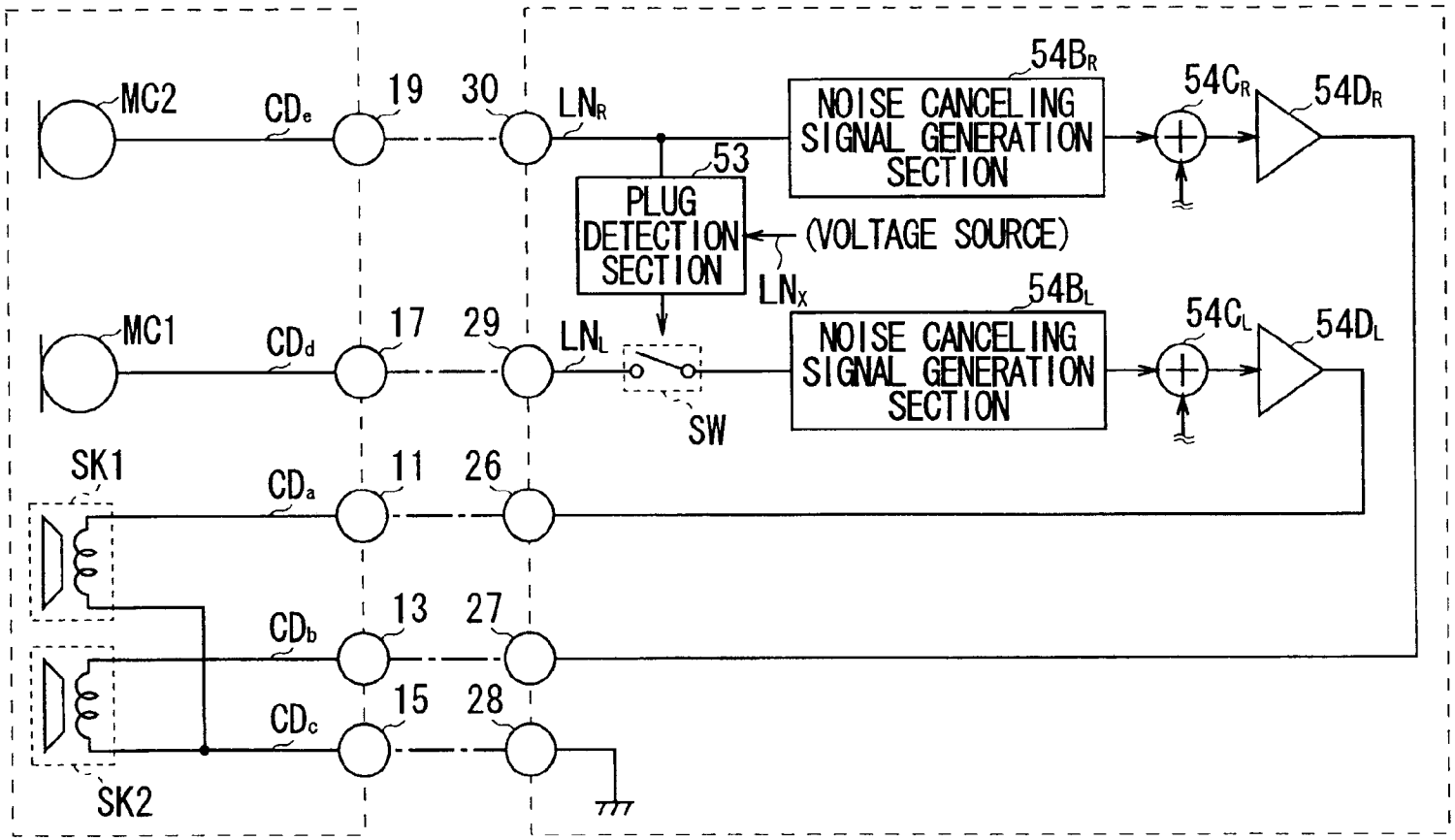
FIG. 15 is a schematic diagram illustrating the connection of a plug detection section.

Following describes how the plug detection section 53 is connected. As shown in FIG. 15, an audio signal line $LN_R$ connected to the jack's terminal (or microphone input terminal) 30, which corresponds to the plug's terminal 19 of the right microphone MC2, is connected to the corresponding noise canceling signal generation section 54$B_R$, combination section 54$C_R$ and signal amplifier 54$D_R$.

A voltage supply line $LN_X$ connected to the plug detection section 53 is connected to the audio signal line $LN_R$ between the jack's terminal (or microphone input terminal) 30 and the noise canceling signal generation section 54$B_R$.

An audio signal line $LN_L$ connected to the jack's terminal (or microphone input terminal) 29, which corresponds to the plug's terminal 17 of the left microphone MC1, is connected to the corresponding noise canceling signal generation section 54$B_L$, combination section 54$C_L$ and signal amplifier 54$D_L$.

A switch SW is connected to the audio signal line $LN_L$ between the jack's terminal (or microphone input terminal) 29 and the noise canceling signal generation section 54$B_L$.

The switch SW is connected to the plug detection section 53. The switch SW is turned off when the plug PLG has been pulled out of the jack JAK while the switch SW is turned on when the plug PLG has been inserted in the jack JAK. The switch SW is controlled by the plug detection section 53.

(1-4-2) Configuration of the Plug Detection Section

Figure 16:
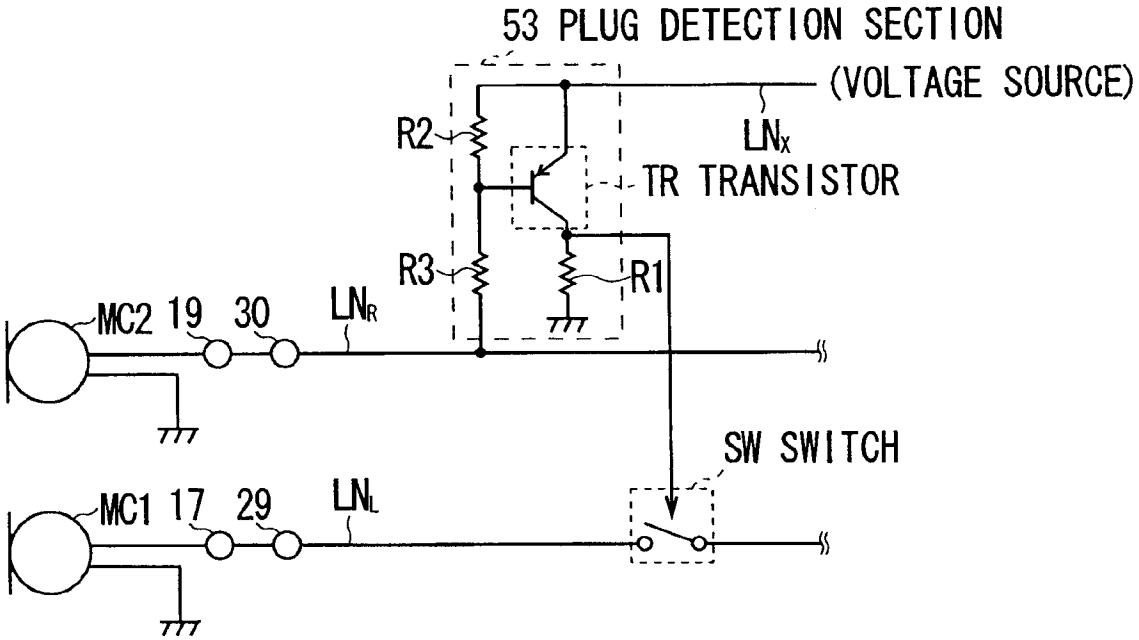
FIG. 16 is a schematic diagram illustrating the configuration of a plug detection section.

The following describes the configuration of the plug detection section 53. As shown in FIG. 16, the plug detection section 53 includes a transistor TR whose emitter is connected to the voltage supply line $LN_X$ and whose collector is connected to the ground via a resistor R1. The switch SW is connected to a middle point between the resistor R1 and the collector.

The base of the transistor is connected to the emitter via a resistor R2 and to the audio signal line $LN_R$ via a resistor R3.

(1-4-3) Operation of the Plug Detection Section when Inserted

When the plug PLG has been pulled out, there is no difference of voltage between the base and collector of the transistor TR. This means that the transistor TR is tuned off. In this case, the switch SW is turned off because a voltage source does not supply voltage to the switch SW.

When the plug PLG is inserted into the jack JAK, the right microphone input terminal 19 of the plug PLG is connected to the corresponding terminal 30 of the jack JAK. In this case, a base current is supplied to the plug detection section 53, causing a difference of voltage between the base and collector of the transistor TR. This means that the transistor TR is tuned on. In this case, the switch SW is turned on because the voltage source supplies voltage to the switch SW.

(1-4-4) Operation of the Plug Detection Section when Pulled Out

While the plug PLG is being pulled out of the jack JAK, the right microphone input terminal 19 of the plug PLG is getting away from the jack's terminal 30. As a result, the base current is not supplied to the plug detection section 53. Therefore, there is no difference of voltage between the base and collector of the transistor TR. This means that the transistor TR is turned off. In this case, the switch SW is turned off because the voltage source does not supply voltage to the switch SW.

(1-4-5) Summary of the Operation of the Plug Detection Section

In that manner, when there is a difference of voltage between the base and collector of the transistor TR connected to the voltage supply line $LN_X$, the switch SW is closed (or turned on). On the other hand, when there is no difference of voltage between the base and collector of the transistor TR, the switch SW is opened (turned off).

(1-5) Operation and Effect

The plug detection section 53 of the portable music player 1 checks the change of voltage on the voltage supply line $LN_X$ connected to the audio signal line $LN_R$, which is connected to the microphone input terminal 30 (FIG. 10 and the like) adjacent to the opening of the plug insertion hole 24*a* of the jack JAK (FIG. 8).

Accordingly, the plug's terminal 19 is first disconnected from the microphone input terminal 30 when the plug PLG is being pulled out of the jack JAK (FIGS. 11 and 12). Accordingly, the switch SW (FIG. 15) is opened by the plug detection section 53 immediately after it has been pulled out and therefore the audio signal line $LN_L$ is shorted.

Accordingly, when the plug PLG is pulled out of the jack JAK (FIGS. 11 and 12), that prevents the signals output from the corresponding signal line $LN_L$ (FIG. 15) from returning even if the jack's microphone input terminal 29 contacts the plug's speaker output terminals 11 and 13. This prevents the oscillation (howling) from happening.

Until the plug is completely inserted into the jack JAK, the microphone input terminal 30 is not connected to the corresponding plug's terminal 19. If the plug is not appropriately inserted into the jack JAK, the switch SW is not closed by the plug detection section 53 and therefore the audio signal line $LN_L$ continues to be shorted.

Accordingly, when the plug PLG is inserted in the jack JAK (FIGS. 11 and 12), that prevents the signals output from the corresponding signal line $LN_L$ (FIG. 15) from returning even if the jack's microphone input terminals 29 and 30 contact the plug's speaker output terminals 11 and 13. This prevents the oscillation (howling) from happening.

In addition, the plug detection section 53 observes the voltage applied to the microphone input terminal 30 (FIG. 10 and the like), which is adjacent to the opening of the plug insertion hole 24*a* (FIG. 8) of the jack JAK. Accordingly, this portable music player 1 can turn on and off the switch SW without being equipped with a switch lever. Therefore, the portable music player 1 can be downsized.

Moreover, in the plug detection section 53 (FIG. 16) according to the present embodiment, the resistances R1 and R2 are disposed such that the transistor TR is tuned on and off in accordance with the base current that flows between the base and collector of the transistor TR through the adjusting resistance R3 (around 3 kΩ) that adjusts the reference voltage supplied from the voltage source. In this manner, not only does the adjusting resistance R3 adjust the reference voltage, but it also serves as a resistance for detecting the plug. Accordingly, the circuit configuration can be simplified.

According to the above configuration, whether the plug PLG is inserted or pulled out is detected by observing the change of the voltage supplied to the microphone input terminal 30 that is adjacent to the opening of the plug insertion hole 24*a* (FIG. 8) of the jack JAK. In response to whether the plug PLG is inserted or pulled out, the audio signal line $LN_L$ is shorted. Accordingly, the multipolar plug PLG may not need to have an additional plug for detecting whether the plug PLG is connected to the jack JAK. This prevents the oscillation (howling) from happening. In addition, the portable music player 1 can be downsized.

(1-6) Other Embodiments

In the above-noted first embodiment, the plug PLG and the jack JAK are designed based on the specification of standard mini plug. However, the present invention is not limited to this. Other plugs and jacks may be applied: a pin plug and jack for earphones (headphones), one of which includes a microphone, a pin plug and jack whose microphone input terminal is monophonic and the like. The connector can be different shapes instead of a pin.

Moreover, in the above-noted first embodiment, the allocation of the terminals of the plug PLG are done in the following manner: a first top terminal for left (or right)

speaker, a second terminal for right (or left) speaker, a third terminal for the ground, a fourth terminal for left (or right) microphone and a fifth terminal for right (or left) microphone (FIG. 2). However, the present invention is not limited to this. The terminals of the plug PLG and jack JAK may be allocated in a different way.

Note that, if there are two or more channels for microphone input, the plug detection section 53 should be connected to a voltage supply line connected to an audio signal line corresponding to a microphone input terminal adjacent to an opening of an insertion hole of a connector and that the switch SW should be connected to the audio signal line corresponding to a microphone input terminal that is far away from an opening of an insertion hole of the connector. Accordingly, that can present the same effect as the above-noted embodiment.

Furthermore, in the above-noted first embodiment, as a suppression means for suppressing output from a signal amplification means, the switch SW on the audio signal line is opened. However, the present invention is not limited to this. Alternatively, the supply of voltage to the signal amplifier 54D may be shut off, or the output level of the signal amplifier 54D may be lowered to a predetermined level to prevent howling from happening.

Furthermore, in the above-noted first embodiment, the plug detection section 53 includes hardware components as shown in FIG. 16. However, the present invention is not limited to this. The plug detection section may be a computer including a CPU, ROM and RAM. In this case, the CPU loads onto the RAM programs read from the ROM, or programs installed from Compact Disc (CD), Digital Versatile Disc (DVD), semiconductor memories or the like, or programs acquired through the Internet, to perform the following process: The CPU detects whether the multipolar plug is inserted or pulled out by observing change of voltage on a voltage supply line and suppresses output from a signal amplification means on an audio signal line if it detects the multipolar plug is pulled out while it does not suppress the output if it detects the multipolar plug is inserted.

Furthermore, in the above-noted first embodiment, the portable music player 1 is equipped with the above configuration. However, the present invention is not limited to this. The above configuration may be applied to other devices having a connector corresponding to a plug that includes an microphone input terminal, such as DVD players, Mini Disc (MD) players, CD players, digital cameras, portable phones, Personal Digital Assistants (PDA), camcorders, television sets and the like.

(2) Second Embodiment (2-1) Basic Principle of Noise Canceling

Figure 17:
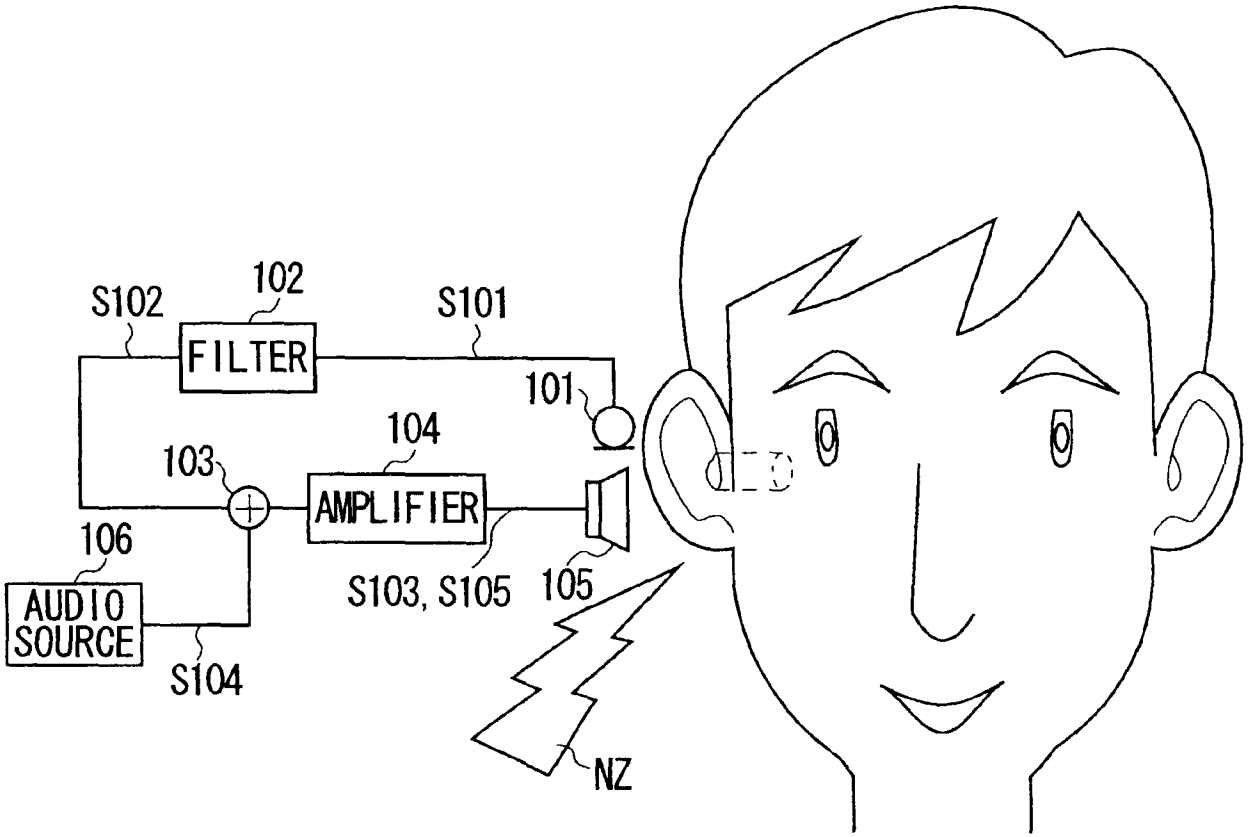
FIG. 17 is a schematic block diagram illustrating the basic principle of noise canceling.

With reference to FIG. 17, the basic principle of noise canceling will be described. A microphone 101, which is adjacent to a user's ear, collects noise NZ around it and then supplies a noise signal S101 representing the noise NZ to a filter 102.

The filter 102 inverts the phase of the noise signal S101 and then supplies via an accumulator 103 to an amplifier 104 the inverted noise signal as a noise reduction signal S102. To eliminate the noise NZ, the amplifier 104 amplifies the amplitude of the noise reduction signal S102 in accordance with the amplitude level of the noise NZ and then supplies a resultant noise reduction signal S103 to a speaker 105. This reduces the noise NZ.

By the way, an audio signal S104, supplied from an audio source 106, is combined with the noise reduction signal S102 by the accumulator 103. The combined signal S105 is supplied to the speaker 105 which then outputs clear sound with reduced noise NZ.

(2-2) Overall Configuration of a Noise Canceling System

Figure 18:
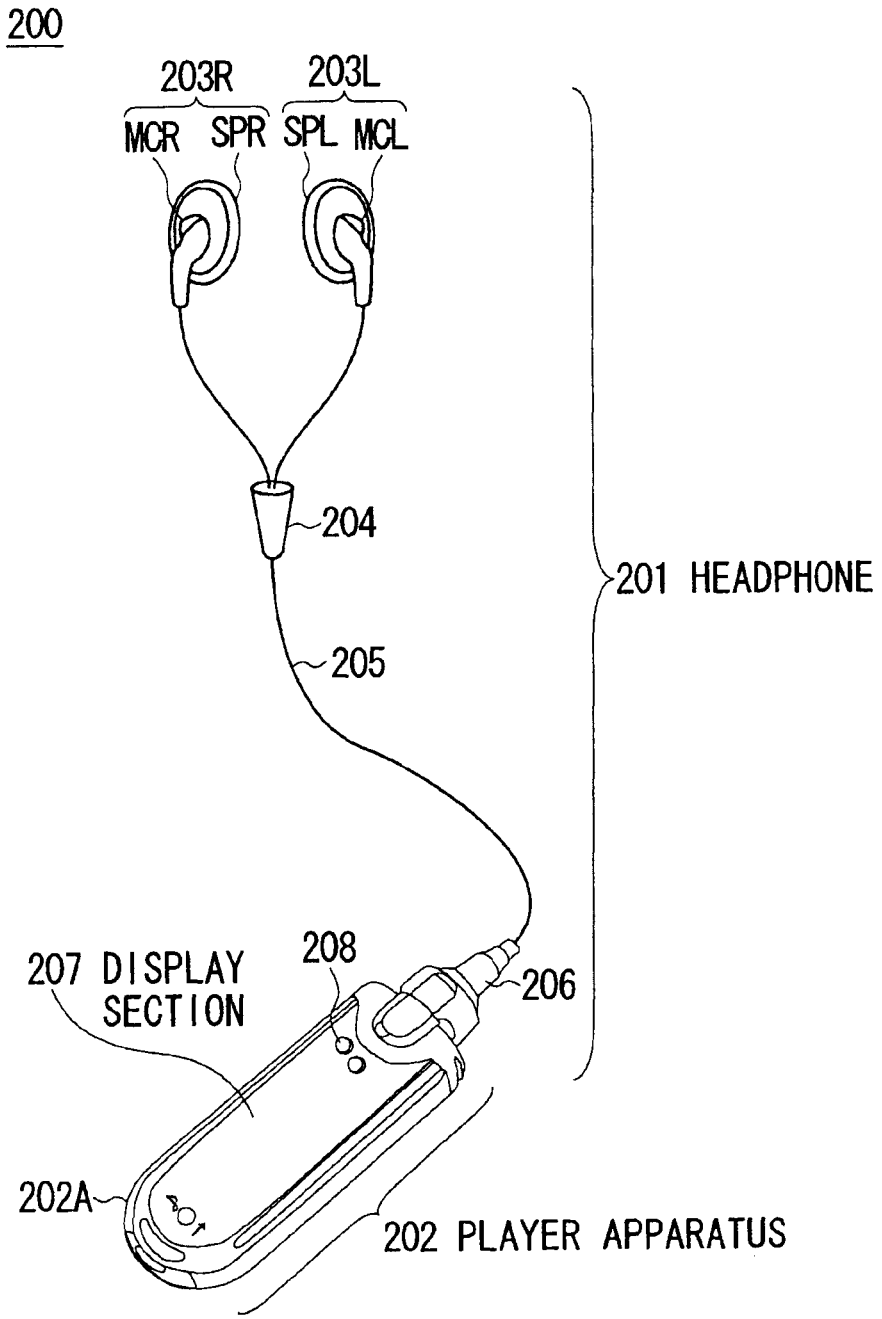
FIG. 18 is a schematic diagram illustrating the overall configuration of a noise canceling system according to an embodiment of the present invention.

In line with the above principle, a noise canceling system is designed. In FIG. 18, the reference numeral 200 denotes a noise reduction system (or a noise canceling system) according to an embodiment of the present invention. The noise reduction system 200 includes a headphone 201 and a player apparatus 202.

The headphone 201 includes a right speaker section 203R and a left speaker section 203L. The right speaker section 203R and the left speaker section 203L include a right speaker SPR and a left speaker SPL, respectively. On the surface of a housing of the right speaker SPR is placed a right microphone MCR. On the surface of a housing of the left speaker SPL is placed a left microphone MCL. The right and left microphones MCR and MCL collect noise around them.

The headphone 201 also includes a connection code 205 that connects the headphone 201 and the player apparatus 202. The connection code 205 includes a separation section 204 (made from resin or the like) at which the code 105 is divided into two, one of which is connected to the right speaker section 203R and the other is connected to the left speaker section 203L. The headphone 201 is designed such that the separation section 204 will be in front of a user's chest when he/she puts on the headphone 201.

In that manner, one end of the headphone 201 has the right speaker section 203R and the left speaker section 203L. The other end of the headphone 201 includes a plug 206, which is at the end of the connection code 205. The headphone 201 and the player apparatus 202 are electrically and mechanically connected to each other by inserting the plug 206 into a jack of the player apparatus 202. In this manner, the noise canceling system 200 is designed.

The player apparatus 202 is a portable music player including a hard disk for storing music data. On the surface of a housing 202A of the player apparatus 202 are placed a display section 207, which is for example a fluorescent display, and various operation buttons 208, such as a playback button and a stop button.

(2-3) Circuit Configuration of the Noise Canceling System

Figure 19:
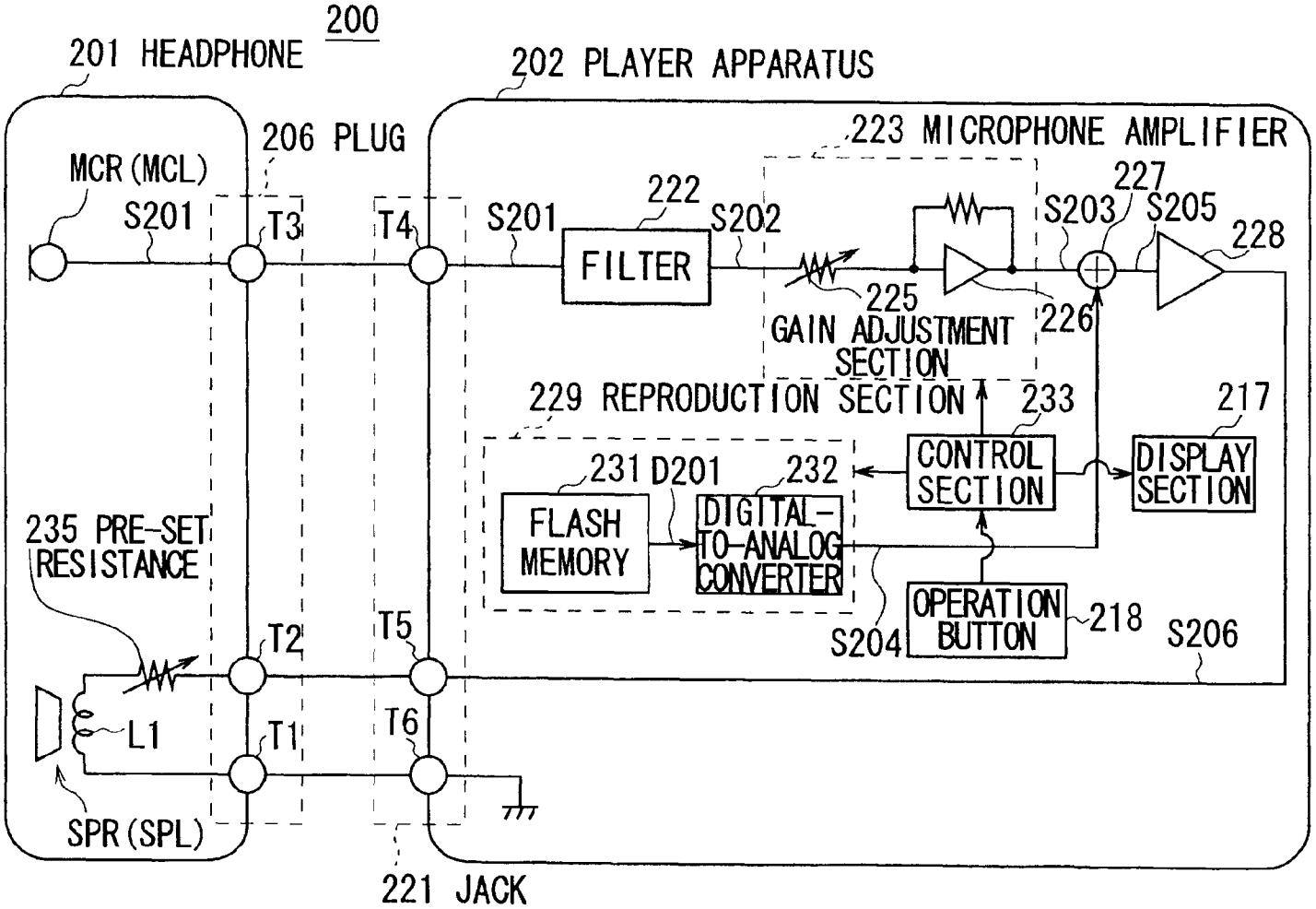
FIG. 19 is a schematic block diagram illustrating the circuit configuration of a noise canceling system according to an embodiment of the present invention.

As shown in FIG. 19, in the noise canceling system 200, the plug 206 of the connection code 205 of the headphone 201 can be electrically connected to the jack 221 of the player apparatus 202.

Specifically, terminals T1 to T3 of the plug 206 can be connected to corresponding terminals T4 to T6 of the jack 221. In this manner, the headphone 201 is electrically and mechanically connected to the player apparatus 202.

Accordingly, when the headphone 201 is electrically connected to the player apparatus 202, the noise canceling system 200 can reduce noise.

Following describes a noise canceling process regarding the right speaker section 203R of the headphone 201. For ease of explanation, the description about the left speaker section 203L, which performs the same process as the right speaker section 203R, is omitted.

The right microphone MCR (left microphone MCL) of the headphone 201 collects noise around it and supplies the resultant noise signal S201 to a filter 222 of the player apparatus 202 via the terminals T3 and T4.

The player apparatus 202 includes the filter 222, a microphone amplifier 223, an accumulator 227, a headphone amplifier 228, a reproduction section 229, a display section 217, an operation button 218 and a control section (i.e. CPU) 233. The CPU 233 reads out from a ROM a basic program and an application program and then executes them to perform various processes.

The filter 222 inverts the noise signal S201 and then supplies the resultant noise reduction signal S202 to the microphone amplifier 223.

The microphone amplifier 223 controls an amplifier 226 to amplify the noise reduction signal S202 to a predetermined level and then supplies the resultant noise reduction signal S203 via the accumulator 227 to the headphone amplifier 228.

Meanwhile, the player apparatus 202 reproduces music data D201 from a flash memory 231 of the reproduction section 229 and then controls a digital-to-analog converter 232 to transforms it into an analog music reproduction signal S204. The accumulator 227 combines the analog music reproduction signal S204 with the noise reduction signal S203 and then supplies the combined signals S205 to the headphone amplifier 228.

The headphone amplifier 228 amplifies the combined signal S205 such that the amplitude of the combined signal S205 substantially becomes equal to that of the noise signal S201 and then supplies the resultant combined signal S206 to the right speaker SPR (left speaker SPL) via the jack's terminal T5 and the plug's terminal T2. This reduces the noise signal S201. Accordingly, the right speaker SPR (left speaker SPL) offers clear sound to the user.

By the way, the player apparatus 202 controls a gain adjustment section 225 of the microphone amplifier 223 to allow the control section 233 to digitally adjust the gain of the amplifier 226. In effect, the gain adjustment process of the gain adjustment section 225 helps suppress variation of the gain of the amplifier 226 and headphone amplifier 228. Therefore, the gain of the combined signals S205, output from the player apparatus 202, can be maintained at a predetermined level.

By the way, when the player apparatus 202 is manufactured in a factory, a worker may control the control section 233 and the gain adjustment section 225 to adjust the gain so that the gain of the combined signals S205 is maintained at a predetermined level. After that, a user, who purchased the apparatus 202, may adjust the variation of the gain of the amplifier 226 and headphone amplifier 228 by pushing the operation button 218 while watching the display section 217.

On the other hand, the headphone 201 includes a pre-set resistor 235 between the headphone amplifier 228 of the player apparatus 202 and a coil L1 of the right speaker SPR (left speaker SPL). When the apparatus is manufactured in a factory, the pre-set resistor 235 is adjusted by a screw and the like to suppress variation regarding the acoustic characteristic of the right speaker SPR (left speaker SPL) and the sensitivity characteristic of the right microphone MCR (left microphone MCL).

In the following description, for ease of explanation, "the acoustic characteristic of the right speaker SPR (left speaker SPL) and the sensitivity characteristic of the right microphone MCR (left microphone MCL)" is also referred to as "the acoustic characteristic of the right speaker SPR (left speaker SPL) and the right microphone MCR (left microphone MCL)".

The screw of the pre-set resistor 235 of the headphone 201 may be sealed by a sticker to prevent a user from changing the adjustment.

In that manner, the gain adjustment section 225 of the microphone amplifier 223 of the player apparatus 202 can adjust and suppress variation of the gain of the amplifier 226 and headphone amplifier 228. In addition, the pre-set resistor 235 of the headphone 201 can adjust and suppress variation regarding the acoustic characteristic of the right speaker SPR (left speaker SPL) and the right microphone MCR (left microphone MCL). In this manner, each section of the noise canceling system 200 fulfills their roles.

In addition, the pre-set resistor 235 of the headphone 201 is in a connection path that connects the right microphone MCR (left microphone MCL), the microphone amplifier 223, the headphone amplifier 228 and the right speaker SPR (left speaker SPL) and is between the headphone amplifier 228 and the right speaker SPR (left speaker SPL). Accordingly, the pre-resistor 235 can suppress overall variation of the player apparatus 202 and headphone 201 when it is adjusted in a factory.

Accordingly, in the noise canceling system 200, the pre-resistor 235 of the headphone 201 adjusts overall variation of the player apparatus 202 and headphone 201. As a result, this suppress variation of the filter 222 of the player apparatus 202 and variation of the shape of the housing to maintain the acoustic characteristic of the right speaker section 203R and left speaker section 203L of the headphone 201.

(2-4) Arrangement of the Pre-Set Resistor

Figure 20:
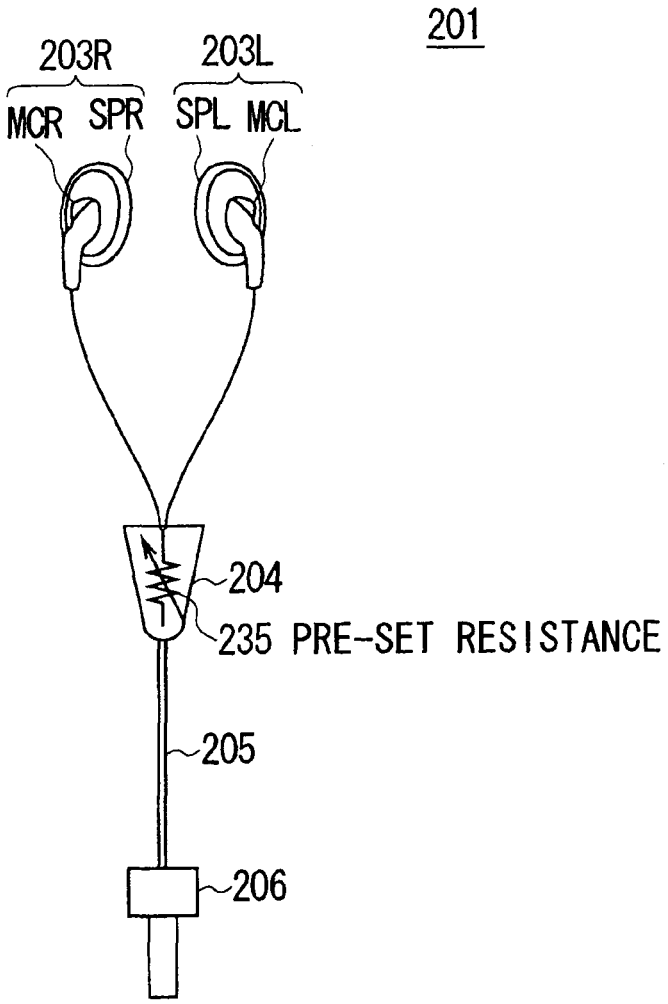
FIG. 20 is a schematic diagram illustrating the arrangement of a pre-set resistor.

In the headphone 201 (FIG. 20), the pre-set resistor 235 is placed inside the separation section 204 at which the connection code 205 is divided for the right speaker section 203R and the left speaker section 203L.

The reason to do that is: if the separation section 204 is between the plug 206 of the connection code 205 (or one end of the connection code 205) and the right and left microphones MCR and MCL placed on the surface of the housings of the right and left speakers SPR and SPL and is close to the plug 206, it may not enhance the effect of noise or the like when a worker adjusts the pre-set resistor 235 in a factory.

Since the headphone 201 is designed such that the separation section 204 will be in front of a worker's chest when he/she wears the headphone 201, it is easy for the worker to adjust the pre-set resistor 235.

(2-5) Combination of the Microphone and the Speaker

The headphone 201 includes the right microphone MCR, the left microphone MCL, the right speaker SPR and the left speaker SPL. There is a variation regarding the sensitivity of those components.

For example, as shown in FIG. 21, there are microphones MCa and MCb: the microphone MCa has the sensitivity variation of about 0 dB to 5 dB while the microphone MCb has the sensitivity variation of about 5 dB to 10 dB. In addition, there are speakers SPa and SPb: the speaker SPa has the output variation of about 0 dB to 5 dB while the speaker SPb has the output variation of about 5 dB to 10 dB. To produce the headphone 201, two elements should be selected from the microphones MCa and MCb and the speakers SPa and SPb.

When the pre-set resistor 235 of the headphone 201 is adjustable in a range of 0 to 15 dB, the combination of the high-sensitivity microphone MCb and the high-power speaker SPb (indicated by dotted lines) may be selected to produce the headphone 201. In this case, as shown in FIG. 22A, the maximum adjusting range reaches 20 dB, exceeding the adjustable range of the pre-set resistor 235 (15 dB).

On the other hand, if the combination of the low-sensitivity microphone MCa and the low-power speaker SPa (indicated by chain lines) may be selected to produce the headphone 201, the maximum adjusting range is 10 dB, within the adjustable range of the pre-set resistor 235 (15 dB).

However, there are not so many components available if the combination of the low-sensitivity microphone MCa and the low-power speaker SPa is chosen. As a result, the cost of manufacturing the headphone 201 may increase with a low yield rate.

Accordingly, to improve the yield rate while keeping it within the adjustable range of the pre-set resistor 235, the combination of the low-sensitivity microphone MCa and the high-power speaker SPb or the combination of the high-sensitivity microphone MCb and the low-power speaker SPa may be chosen to produce the headphone 201, as shown in FIG. 21. As a result, as shown in FIG. 22B, the maximum adjusting range becomes 5 to 15 dB, within the adjustable range of the pre-set resistor 235 (15 dB).

In that manner, the combination of the low-sensitivity microphone MCa and the high-power speaker SPb or the combination of the high-sensitivity microphone MCb and the low-power speaker SPa may be chosen to improve the yield rate while increasing the number of components and elements available for manufacturing. In addition, the pre-set resistor 235 suppresses variation regarding the acoustic characteristic of the speakers SPa and SPb and the sensitivity characteristic of the microphones MCa and MCb.

In fact, the headphone 201 is designed such that the combination of the low-sensitivity right microphone MCR (left microphone MCL) and the high-power right speaker SPR (left speaker SPL) or the combination of the high-sensitivity right microphone MCR (left microphone MCL) and the low-power right speaker SPR (left speaker SPL) can be chosen.

(2-6) Operation and Effect

The noise canceling system 200 includes the gain adjustment section 225 of the microphone amplifier 223 that adjusts and suppresses variation of the gain of the amplifier 226 and headphone amplifier 228 of the player apparatus 202. In addition, the noise canceling system 200 includes the pre-set resistor 235 that adjusts and suppresses variation regarding the acoustic characteristic of the right microphone MCR (left microphone MCL) of the headphone 201 and the right speaker SPR (left speaker SPL).

In that manner, the player apparatus 202 utilizes the gain adjustment section 225 to adjust the gain of the amplifier 226 and headphone amplifier 228 in order to maintain the gain of the combined signal S206 (output from the player apparatus 202) at a predetermined level.

The headphone 201 utilizes the pre-set resistor 235 to adjust variation regarding the acoustic characteristic of the right microphone MCR (left microphone MCL) of the headphone 201 and the right speaker SPR (left speaker SPL).

Thus, the manufacturer, who produces many headphone sets 201, can suppress the variation and maintain the acoustic characteristic.

Even if the many pairs of the player apparatus 202 and the headphone 201 are produced at once, the manufacturer can maintain the noise canceling ability of all the products they produced.

If the pre-set resistor 235 of the headphone 201 is adjusted when the headphone 201 is connected to the player apparatus 202 in a factory, this can suppress the overall variation regarding the player apparatus 202 and the headphone 201. In this manner, even if the manufacturer produces many sets of the noise canceling systems 200 (the headphone 201 and the player apparatus 202), each set may have substantially the same level of noise canceling capability.

In addition, in the noise canceling system 200, the gain adjustment section 225, which adjusts the gain (electric characteristic) of the amplifier 226 and headphone amplifier 228, is placed inside the player apparatus 202. In addition, the pre-set resistor 235, which adjusts variation regarding the acoustic characteristic of the right microphone MCR (left microphone MCL) and the right speaker SPR (left speaker SPL), is placed in the separation section 214 of the headphone 201. That can downsize the right speaker section 203 and the left speaker section 203L while the appearance of the system seems not to have any features about the noise canceling mechanism.

Noise canceling may not work well if the other user's headphone 201 is connected to the player apparatus 202.

Accordingly, the noise canceling system 200 allows a user to adjust the gain adjustment section 225 of the microphone amplifier 223 through the operation button 208 of the player apparatus 202 that issues a command to the control section 233. Accordingly, even if a different headphone 201 is connected to the player apparatus 202, the noise canceling system may work effectively.

According to the above configuration, the noise canceling system 200 can be downsized. In addition, the noise canceling system 200 can appropriately reduce the noise. Moreover, the noise canceling system 200 is easy-to-use.

(2-7) Other Embodiments

In the above-noted second embodiment, a typical headphone 201 is applied. However, the present invention is not limited to this. Other types of headphones and earphones, such as an ear-hang type earphone, an inner-ear type earphone, a headphone with a headband or a neckband, may be applied.

Moreover, in the above-noted second embodiment, the pre-set resistor 235 is placed inside the separation section 204. However, the present invention is not limited to this. The pre-set resistor 235 may be placed in the plug 206 to reduce noise at the same rate as that of the above-noted embodiment. Alternatively, the pre-set resistor 235 may be placed in the housing of the right or left speaker section 203R or 203L to reduce noise to a certain extent.

Furthermore, in the above-noted second embodiment, the player apparatus 202 is applied as an electronic device which is part of the noise canceling system 200. However, the present invention is not limited to this. Instead of the player apparatus 202, a recording and reproducing apparatus, a radio receiver or an amplification apparatus (not including the reproduction section 229) may be applied.

Furthermore, in the above-second embodiment, there are hardware components, such as the filter 222, the microphone amplifier 223, the accumulator 227 and the headphone amplifier 228, to perform the noise canceling process. However, the present invention is not limited to this. The filter 222, the microphone amplifier 223, the accumulator 227 and the headphone amplifier 228 can be software components. That is, the control section 223 executes an application program, such as a noise reduction program read out from the ROM, to perform the noise canceling process.

By the way, instead of being read out from the ROM, the noise canceling program may be installed from a storage medium or may be acquired through the Internet.

Furthermore, in the above-noted second embodiment, the player apparatus (electronic apparatus) 202 includes, as a first adjustment means, the gain adjustment section 225 in the microphone amplifier 223 while the headphone 201 includes, as an adjustment means and second adjustment means, the pre-set resistor 235 followed by the right speaker SPR (left speaker SPL). However, the present invention is not limited to this. The gain adjustment section 225 and the pre-set resistor 235 may be placed at a different position: the gain adjustment section 225 may follow the amplifier 226 while the pre-set resistor 235 may follow the right speaker SPR (left speaker SPL). This may present the same effect as the above-noted embodiment.

(3) Third Embodiment

The appearance configuration of a portable music player of the third embodiment is the same as that of the portable music player 1 (FIG. 1) of the first embodiment. The configuration of a plug and jack of the third embodiment is the same as that of the plug PLG and jack JAK of the first embodiment (FIGS. 2 to 12).

(3-1) Circuit Configuration of the Portable Music Player

Figure 23:
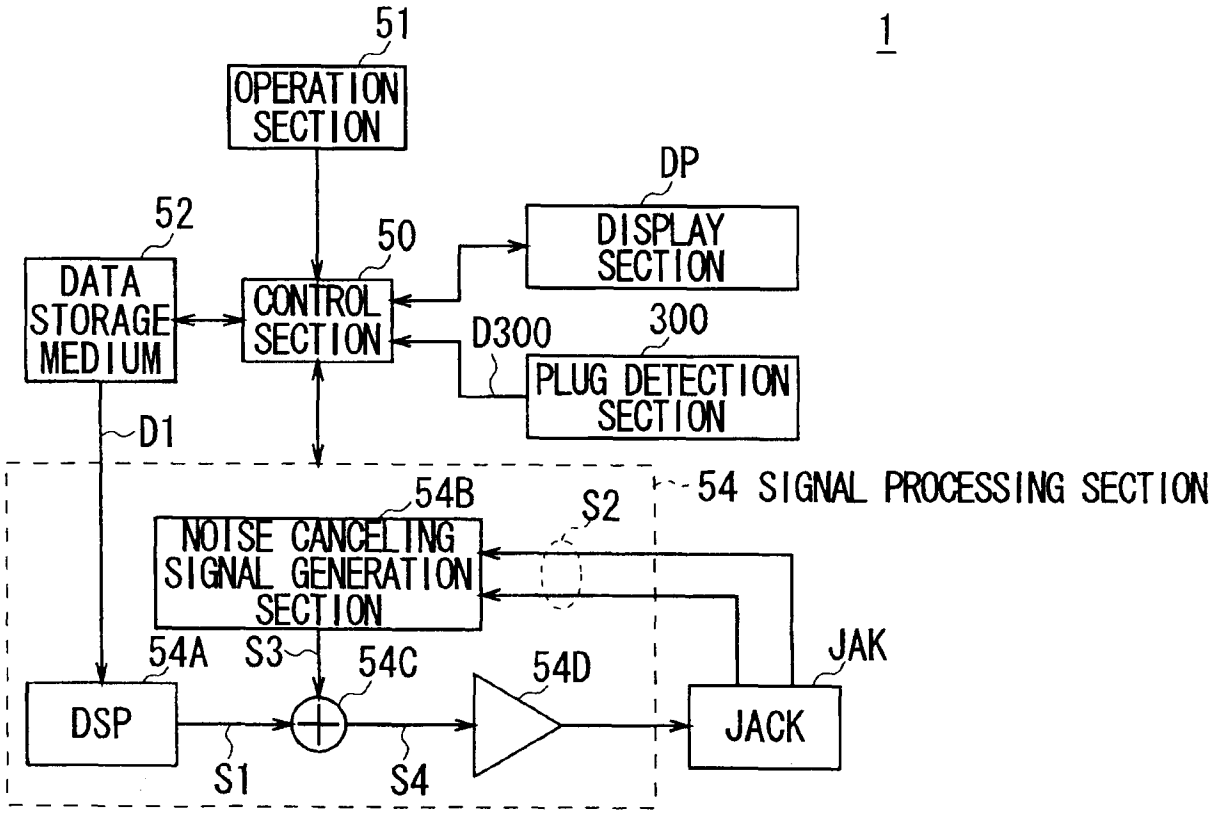
FIG. 23 is a block diagram illustrating the circuit configuration of a portable music player according to a third embodiment of the present invention.

FIG. 23 illustrates the circuit configuration of the portable music player 1 according to the third embodiment (The parts of FIG. 23 have been designated by the same reference numerals and symbols as the corresponding parts of FIG. 3). Instead of the plug detection section 53 (FIG. 1), the portable music player 1 includes a plug detection section 300.

(3-2) Configuration of the Plug Detection Section

Figure 24:
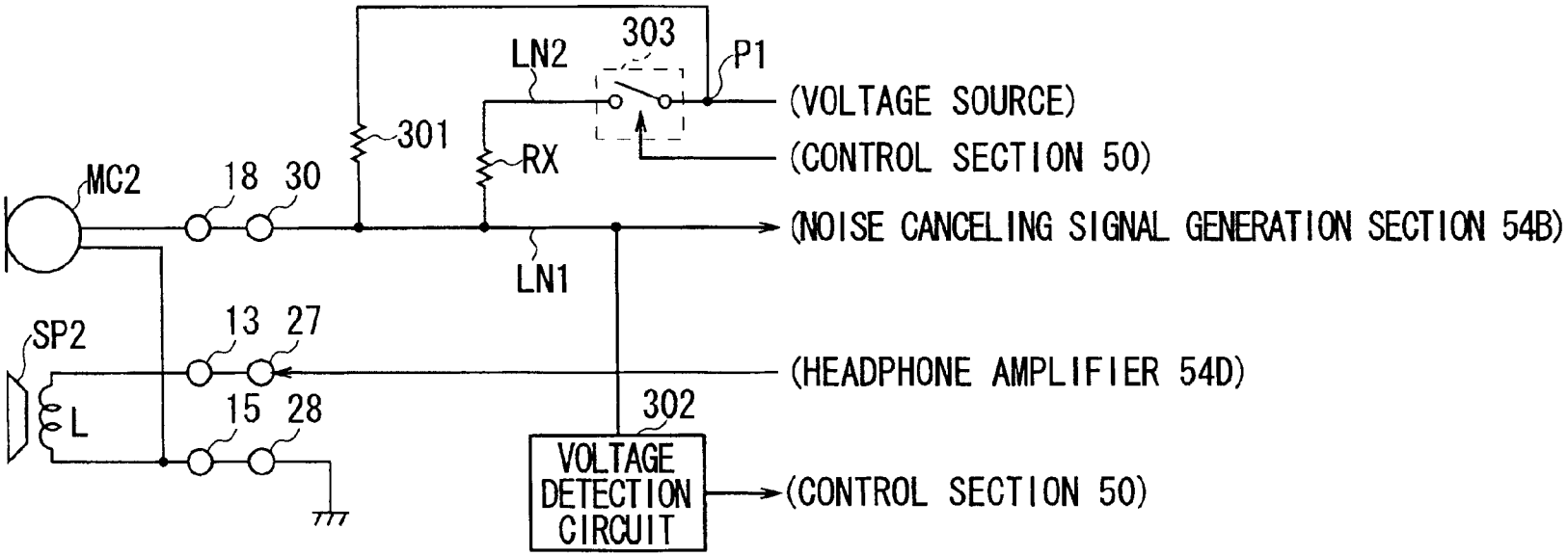
FIG. 24 is a schematic diagram illustrating the configuration of a plug detection section.

As shown in FIG. 24, the plug detection section 300 includes a resistance 301, a voltage detection circuit 302 and a switch 303.

The resistance 301 is placed between an audio input line LN1, which is connected to the terminal (microphone input terminal) 30 to which an audio signal is supplied from the right microphone MC2, and a voltage supply line LN2, which is connected to the audio input line LN1.

In addition, the resistance 301 is connected in parallel to an adjusting resistance RX on the voltage supply line LN2, the adjusting resistance RX adjusting a reference voltage applied to the right microphone MC2.

The voltage detection circuit 302 is connected to the audio input line LN1 to observe a change of voltage on the audio input line LN1.

The switch 303 on the voltage supply line LN2 is placed between a connection point P1 of the resistance 301 and the adjusting resistance RX. The switch 303 is opened when running in a detection mode for detecting whether the plug PLG of the noise canceling headphone is connected. The switch 303 is closed when running in an audio input mode in which an audio signal is supplied from the microphone MC.

If the plug PLG of the noise canceling headphone is not connected while the switch 303 is opened (i.e. the detection mode), the terminal (microphone input terminal) 30 is an open end. As a result, the voltage is supplied from the voltage source of the portable music player 1 to the voltage detection circuit 302 via the connection point P1 and the resistance 301.

On the other hand, if the plug PLG of the noise canceling headphone is connected while the switch 303 is opened (i.e. the detection mode), the terminal (microphone input terminal) 30 is being connected to the right microphone MC2. As a result, the voltage is supplied from the voltage source of the portable music player 1 to the ground via the connection point P1, the resistance 301 and the right microphone MC2. Accordingly, the voltage supplied to the voltage detection circuit 302 drops.

The voltage detection circuit 302 is designed to detect whether that voltage exceeds a high level (threshold) or the voltage decreases below a low level (threshold). When the voltage detection circuit 302 detects that the voltage supplied to the voltage detection circuit 302 has exceeded the high level, it determines that the plug PLG of the noise canceling headphone is not connected. On the other hand, when the voltage detection circuit 302 detects that the voltage supplied to the voltage detection circuit 302 has decreased below the low level, it determines that the plug PLG of the noise canceling headphone is connected.

When the plug PLG of the noise canceling headphone is connected (i.e. when the voltage supplied to the voltage detection circuit 302 has decreased below the low level), the voltage detection circuit 302 creates a positive pulse (or negative pulse) as connection notification data D300 (FIG. 23) to notify the control section 50 of the fact that the plug PLG is connected.

In this embodiment, the value of the resistance 301 is determined such that: the value of the resistance 301 is greater than or equal to the result of multiplying the value of resistance of the microphone-attached earphone MC2 by the ratio of the high level to the low level (the thresholds of the voltage detection circuit 302) and is less than or equal to the result of dividing the value of resistance of the voltage detection circuit 302 by that level ratio. In fact, in this embodiment, the value of the resistance 301 is 100 kΩ, while the adjusting resistance RX is 3 kΩ.

When the plug PLG of the noise canceling headphone is connected, an audio signal may be supplied from the microphone-attached earphone MC2 to the audio input line LN1 via the terminal (microphone input terminal) 30. Nonetheless, the plug detection section 300 (or the voltage detection circuit 302) can precisely detect whether the plug PLG is connected even if the voltage of the audio input line LN1 may change due to the audio signal.

In addition, when the plug PLG of the noise canceling headphone is not connected, a noise may be input through the terminal (microphone input terminal) 30. Nonetheless, the plug detection section 300 (or the voltage detection circuit 302) can precisely detect whether the plug PLG is connected even if the voltage of the audio input line LN1 may change due to the noise.

On the other hand, when the switch 303 is closed (i.e. the audio input mode), the voltage supplied from the voltage source of the portable music player 1 is divided by the resistance 301 and the adjusting resistance RX to offer a reference voltage to the microphone-attached earphone MC2. The audio signal supplied from the microphone-attached earphone MC2 via the terminal (microphone input terminal) 30 is supplied to the noise canceling signal generation section 54B via the audio input line LN1.

In that manner, the plug detection section 300 running in the detection mode detects, through the audio input line LN1, whether the plug PLG of the noise canceling headphone is connected.

(3-3) Mode Switch Process

Figure 25:
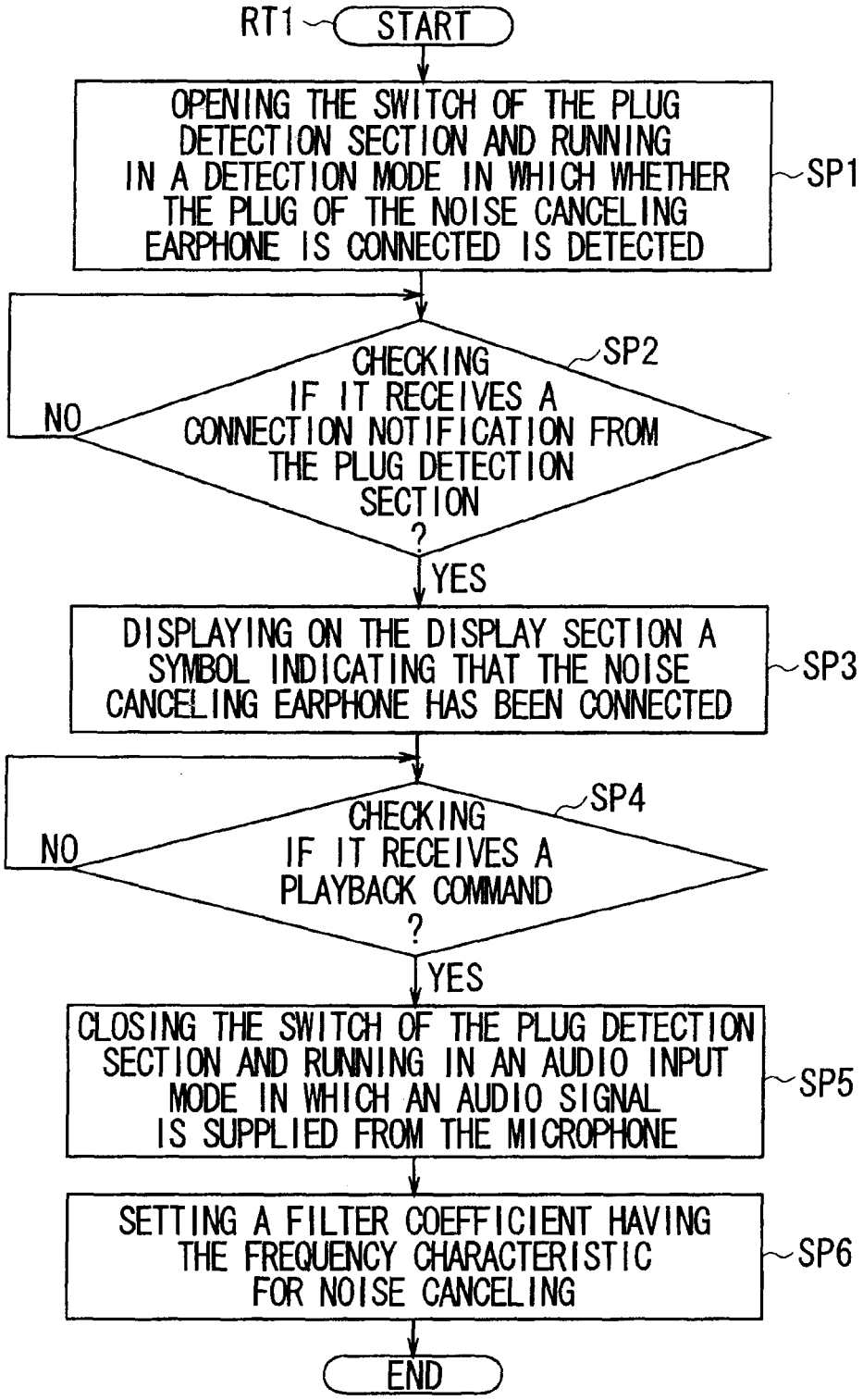
FIG. 25 is a flowchart illustrating the procedure of a mode switch process.

The control section 50 performs a mode switch process in which the control section 50 switches from the detection mode to the audio input mode. FIG. 25 is a flowchart illustrating the mode switch process.

When being powered on, the control section 50 starts a procedure RT1 of the mode switch process. At step SP1, the control section 50 opens the switch 303 of the plug detection section 300 (FIG. 24) to allow the plug detection section 300 to detect, through the audio input line LN1 (FIG. 24), whether the plug PLG of the noise canceling headphone is connected (i.e. the detection mode).

The control section 50 subsequently proceeds to step SP2. At step SP2, the control section 50 waits until it is notified by the voltage detection circuit 302 of the plug detection section 300 (FIG. 24) of the fact that the plug PLG has been connected.

Based on the connection notification data D300 from the plug detection section 300, the control section 50 recognizes that the plug PLG has been connected and then proceeds to next step SP3. At step SP3, the control section 50 displays, on a predetermined position of the display screen on the display section DP (FIG. 14), the symbol AC4 in a different color from other symbols to notify the user of the fact that the noise canceling headphone has been connected.

The control section 50 subsequently proceeds to step SP4. At step SP4, the control section 50 waits until it receives a playback command regarding the digital audio signal D1 stored in the data storage medium 52. After having received the playback command from the operation section 51 (FIG. 23), the control section 50 proceeds to step SP5 and then closes the switch 303 of the plug detection section 300 (FIG. 24) to allow the audio signal to be input through the audio input line LN1 (i.e. the audio input mode). At this time, the detection process by the plug detection section 300 is stopped.

The control section 50 subsequently proceeds to step SP6. At step SP6, the control section 50 replaces the default second filter coefficient (for non-noise canceling mode) set in the DSP 54A (FIG. 23) with the first filter coefficient (for noise canceling mode) and then ends the procedure RT1 of the mode switch process.

In that manner, the control section 50 switches from the detection mode to the audio input mode.

(3-4) Operation and Effect

As shown in FIG. 24, the portable music player 1 includes a plurality of connector terminals 26, 27, 28, 29 and 30 (FIGS. 9 and 10, for example) of the jack JAK corresponding to the multipolar plug PLG. The resistance 301 is placed between the audio input line L1, which is connected to the connector terminal 30 corresponding to a plug terminal connected to the right microphone MC2, and the voltage supply line LN2, which supplies the voltage to the right microphone MC2 via the audio input line LN1.

The portable music player 1 includes the voltage detection circuit 302 that detects the change of voltage on the audio input line LN1 to detect whether the plug PLG of the noise canceling headphone is connected. The voltage detection circuit 302 is connected to the audio input line LN1. The switch 303 is provided between the connection point P1, which is one end of the resistance 301 that is close to the voltage supply line LN2, and the adjusting resistance RX, which is provided on the voltage supply line LN2.

The portable music player 1 keeps opening the switch 303 until it is notified by the voltage detection circuit 302 of the fact that the multipolar plug PLG of the noise canceling headphone has been connected and it receives the playback command from the operation section 51.

Accordingly, when the switch is opened, the voltage detection circuit 302 of the portable music player 1 observes the change of the voltage supplied from the voltage supply line LN2 via the resistance 301 to the audio input line LN1 to detect whether the multipolar plug PLG of the noise canceling headphone is connected.

On the other hand, when the switch is closed, the resistance 301 and the adjusting resistance RX divides up the voltage supplied from the voltage supply line LN2 to offer the reference voltage, which is supplied to the right microphone MC2. In addition, the right microphone MC2 can input an audio signal.

In that manner, the portable music player 1 uses the voltage supply line LN2 for both supplying the voltage and detecting whether the multipolar plug PLG of the noise canceling headphone is connected.

According to the above configuration, the portable music player 1 uses the voltage supply line LN2 for both supplying the voltage and detecting whether the multipolar plug PLG of the noise canceling headphone is connected. Accordingly, the multipolar plug PLG does not have to have an additional terminal for detecting the connection. Thus, the portable music player 1 can be downsized.

(3-5) Other Embodiments

In the above-noted third embodiment, the plug PLG and the jack JAK are designed based on the specification of standard mini plug. However, the present invention is not limited to this. Other pin plugs and pin jacks may be applied. The connector can be different shapes instead of a pin.

Moreover, in the above-noted third embodiment, the allocation of the terminals of the plug PLG are done in the following manner: a first top terminal for left (or right) speaker, a second terminal for right (or left) speaker, a third terminal for the ground, a fourth terminal for left (or right) microphone and a fifth terminal for right (or left) microphone (FIG. 2). However, the present invention is not limited to this. The terminals of the plug PLG and jack JAK may be allocated in a different way.

Furthermore, in the above-noted third embodiment, the switch 303 (FIG. 24) is closed after that it is notified of the fact that the plug PLG of the noise canceling headphone has been connected and that it receives the playback command from the operation section 51. However, the present invention is not limited to this. The switch 303 may be closed immediately after the notification. In this case, the noise-canceled audio signal can be swiftly output to the corresponding terminal of the plug PLG even if the plug PLG gets connected while music is being played.

In that case, instead of detecting change of voltage on the audio input line connected to the terminal 30 which is relatively far away from the opening of the plug insertion hole 24*a* (FIG. 8), the plug detection section detects, like the above-noted third embodiment, change of voltage on the audio input line LN1 connected to the terminal 29 which is relatively close to the opening of the plug insertion hole 24*a* (FIG. 8). Accordingly, the plug detection section can swiftly detect whether the plug PLG of the noise canceling headphone is connected.

Furthermore, in the above-noted third embodiment, the plug detection section observes a change of voltage of the audio input line connected to the terminal 30 corresponding to the plug's terminal 19 connected to the right microphone MC2. However, the present invention is not limited to this. The plug detection section may observe a change of voltage of a video input line connected to a terminal corresponding to a plug's terminal connected to a camera. In this manner, the plug detection section may observe a change of voltage of an input line connected to a terminal corresponding to a plug's terminal of an input device.

Furthermore, in the above-noted third embodiment, the control section 50 reads out a program from the ROM, loads it onto the RAM and then executes it to perform the mode switch process (FIG. 25). However, the present invention is not limited to this. The program may be installed from CD, DVD, semiconductor memories or the like, or may be acquired through the Internet.

Furthermore, in the above-noted third embodiment, the portable music player 1 is equipped with the above configuration. However, the present invention is not limited to this. The above configuration may be applied to other devices having a connector corresponding to a plug of an input device, such as DVD players, Mini Disc (MD) players, CD players, digital cameras, portable phones, Personal Digital Assistants (PDA), camcorders, television sets and the like.

(4) The Plug Detection Section in the First and Third Embodiments

Figure 26:
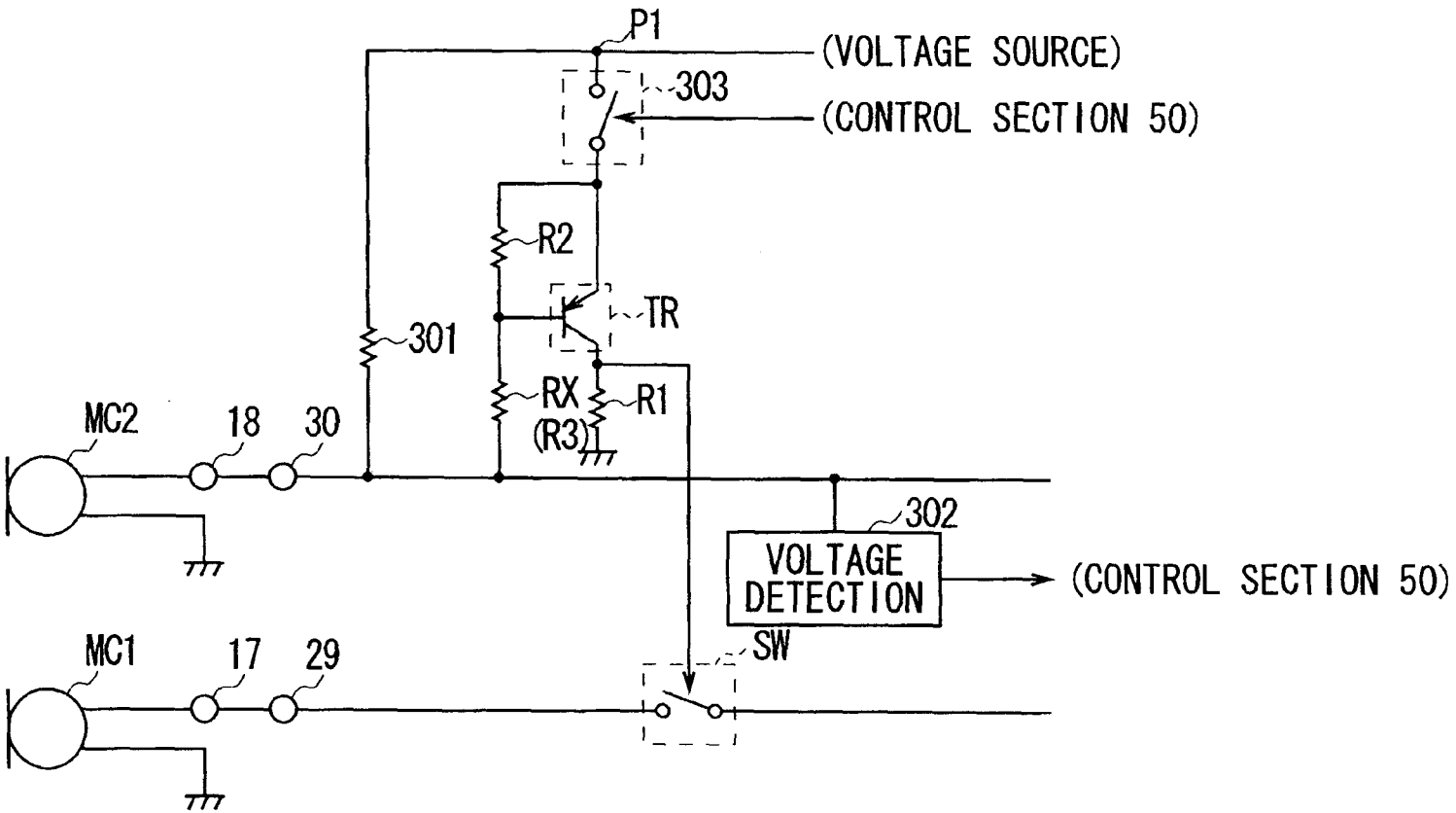
FIG. 26 is a schematic diagram illustrating the combination of the plug detection sections (First and Third Embodiments).

The configuration of the plug detection section 53 (First Embodiment) can be combined with that of the plug detection section 300 (Third Embodiment). In this case, the combined plug detection section may have the configuration as shown in FIG. 26 (The parts of FIG. 26 have been designated by the same reference numerals and symbols as the corresponding parts of FIGS. 16 and 24). Accordingly, the control section 50 of the portable music player 1 can prevent howling from happening and detect the connection of the noise canceling headphone's plug PLG.

The above method may be utilized under the circumstances where a noise level is high, such as inside a vehicle or airplane.

It should be understood by those skilled in the art that various modifications, combinations, sub-combinations and alterations may occur depending on design requirements and other factors insofar as they are within the scope of the appended claims or the equivalents thereof.

What is claimed is:

1. An input switching apparatus comprising:

a resistance provided between a signal input line connected to a connector terminal corresponding to a plug terminal connected to an input device and a voltage supply line that supplies voltage to the input device via the signal input line, the connector terminal being one of the connector terminals provided on a connector that supports a multipolar plug;

circuitry configured to perform as a detection section connected to the signal input line, the detection section detecting whether the multipolar plug is connected by observing a change of voltage of the signal input line;

an open switch provided between a connection point of the resistance on the side of the voltage supply line and an adjusting resistance provided on the voltage supply line, the adjusting resistance adjusting the voltage; and circuitry configured to perform as a control section that closes the open switch when the detection section detects that the multipolar plug is connected based on the change of the voltage of the signal input line, wherein the resistance and the adjusting resistance are commonly connected to the signal input line.

2. The input switching apparatus according to claim 1, wherein a value of the resistance is determined such that the value of the resistance is greater than or equal to the result of multiplying a value of resistance of the input device and a ratio of a high level value to a low level value and is less than or equal to the result of dividing a value of resistance of the detection section by the ratio, the high and low level values being set in the detection section as thresholds regarding change of voltage.

3. The input switching apparatus according to claim 1, wherein the signal input line is an audio input line connected to the connector terminal corresponding to a plug terminal connected to an audio collection section.

4. The input switching apparatus according to claim 3, wherein the control section displays on a display section an icon indicating the fact that a noise canceling earphone or headphone has been connected when the detection section detects that the multipolar plug is connected.

5. The input switching apparatus according to claim 3, wherein the control section sets, when the detection section detects that the multipolar plug is connected, a filter coefficient having the frequency characteristic for noise canceling in a signal processor that processes a reproduction audio signal.

6. An input switching method comprising:

controlling circuitry configured to perform as a detection section to detect whether a multipolar plug is connected by observing a change of voltage of a signal input line connected to a connector terminal corresponding to a plug terminal connected to an input device, the connector terminal being one of the connector terminals provided on a connector that supports the multipolar plug; and closing, when the detection section when the detection section detects that the multipolar plug is connected based on the change of the voltage of the signal input line, an open switch provided between an adjusting resistance provided on a voltage supply line to adjust a voltage supplied from the voltage supply line to the input device via the signal input line and a connection point of a resistance provided between the voltage supply line and the signal input line, the connection point being on the side of the voltage supply line, wherein the resistance and the adjusting resistance are commonly connected to the signal input line.

7. A non-transitory computer-readable storage medium storing a computer-readable program for causing a computer to execute instructions for performing a method comprising:

controlling circuitry configured to perform as a detection section to detect whether a multipolar plug is connected by observing change of voltage of a signal input line connected to a connector terminal corresponding to a plug terminal connected to an input device, the connector terminal being one of the connector terminals provided on a connector that supports the multipolar plug; and closing, when detection section when the detection section detects that the multipolar plug is connected based on the change of the voltage of the signal input line, an open switch provided between an adjusting resistance provided on a voltage supply line to adjust a voltage supplied from the voltage supply line to the input device via the signal input line and a connection point of a resistance provided between the voltage supply line and the signal input line, the connection point being on the side of the voltage supply line, wherein the resistance and the adjusting resistance are commonly connected to the signal input line.

8. A portable music player comprising:

right and left noise canceling earphones, each including a corresponding microphone; and the input switching apparatus according to claim 1, wherein the signal input line of the input switching apparatus is connected to one of the microphones corresponding to the noise canceling earphones.

9. A portable music player comprising:

right and left noise canceling earphones, each including a corresponding microphone; and circuitry configured to perform the input switching method according to claim 6, wherein the signal input line is connected to one of the microphones corresponding to the noise canceling earphones.

10. A portable music player comprising:

right and left noise canceling earphones, each including a corresponding microphone; and the non-transitory computer-readable storage medium according to claim 7, wherein the signal input line is connected to one of the microphones corresponding to the noise canceling earphones.

* * * * *